US009820055B2

(12) United States Patent
Babayoff et al.

(10) Patent No.: US 9,820,055 B2
(45) Date of Patent: Nov. 14, 2017

(54) TRANSDUCER SYSTEM

(71) Applicant: NOVETO SYSTEMS LTD., Rishon Lezion (IL)

(72) Inventors: Noam Babayoff, Rishon Lezion (IL); Tomer Shani, Rishon Lezion (IL)

(73) Assignee: NOVETO SYSTEMS LTD., Rishon Lezion (IL)

( * ) Notice: Subject to any disclaimer, the term of this patent is extended or adjusted under 35 U.S.C. 154(b) by 0 days.

(21) Appl. No.: 14/778,061

(22) PCT Filed: Mar. 20, 2014

(86) PCT No.: PCT/IL2014/050307
§ 371 (c)(1),
(2) Date: Sep. 17, 2015

(87) PCT Pub. No.: WO2014/147625
PCT Pub. Date: Sep. 25, 2014

(65) Prior Publication Data

US 2016/0277843 A1 Sep. 22, 2016

(30) Foreign Application Priority Data

Mar. 21, 2013 (IL) ..... 225374

(51) Int. Cl.
*H04R 17/00* (2006.01)
*H04R 3/00* (2006.01)
*H04R 17/02* (2006.01)

(52) U.S. Cl.
CPC ..... *H04R 17/00* (2013.01); *H04R 3/00* (2013.01); *H04R 17/005* (2013.01);
(Continued)

(58) Field of Classification Search
None
See application file for complete search history.

(56) References Cited

U.S. PATENT DOCUMENTS 6,332,029 B1 * 12/2001 Azima ..... B42D 15/022 181/166
6,427,017 B1 7/2002 Toki
(Continued)

FOREIGN PATENT DOCUMENTS

GB 2343811 5/2000
WO WO 2014/076707 5/2014

OTHER PUBLICATIONS

International Search Report from International Application PCT/IL2014-050307 dated Jun. 27, 2014.

*Primary Examiner* — Curtis Kuntz
*Assistant Examiner* — Qin Zhu
(74) *Attorney, Agent, or Firm* — Dorsey & Whitney LLP

(57) ABSTRACT

A transducer system includes a panel having one or more piezo-electric enabled foils and an arrangement of electric contacts coupled to the panel. The one or more piezo-electric enabled foils and the arrangement of electric contacts define a plurality of transducers thereon. Each transducer is associated with a respective region of the panel and with at least two electric contacts that are coupled to at least two zones at that respective region of the panel. The electric contacts are adapted to provide an electric field in these at least two zones to cause different degrees of piezo-electric material deformation in these at least two zones and to thereby deform the respective region of the panel in a direction substantially perpendicular to a surface of the panel, and to thereby enable efficient conversion of electrical signals to mechanical vibrations (acoustic waves) and/or vice versa.

20 Claims, 8 Drawing Sheets

(52) U.S. Cl.
CPC ..... *H04R 17/025* (2013.01); *H04R 2201/401* (2013.01); *H04R 2217/03* (2013.01); *H04R 2400/01* (2013.01); *H04R 2499/11* (2013.01); *H04R 2499/15* (2013.01)

(56) References Cited

U.S. PATENT DOCUMENTS

| | | | | |
|---|---|---|---|---|
| 7,447,324 | B2 * | 11/2008 | Ogawa | B06B 1/0611 367/140 |
| 7,889,877 | B2 * | 2/2011 | Lutz | F04B 43/046 381/190 |
| 2005/0018870 | A1 * | 1/2005 | Tanaka | H04R 17/00 381/430 |
| 2006/0197413 | A9 * | 9/2006 | Takeuchi | B81B 3/0018 310/328 |
| 2007/0046642 | A1 | 3/2007 | Lee et al. | |
| 2007/0081681 | A1 | 4/2007 | Yu et al. | |
| 2010/0007243 | A1 * | 1/2010 | Engel | H01L 41/083 310/322 |
| 2010/0067726 | A1 * | 3/2010 | Suzuki | G06F 1/1605 381/333 |
| 2010/0246863 | A1 * | 9/2010 | Onishi | H04R 17/00 381/190 |
| 2010/0296677 | A1 * | 11/2010 | Jiang | B82Y 30/00 381/190 |
| 2011/0033074 | A1 | 2/2011 | Chang et al. | |
| 2011/0062829 | A1 | 3/2011 | Andoh et al. | |
| 2011/0110542 | A1 * | 5/2011 | Masuda | B06B 1/0603 381/190 |
| 2011/0128245 | A1 * | 6/2011 | Andoh | H04R 17/005 345/173 |
| 2011/0261021 | A1 | 10/2011 | Modarres et al. | |
| 2012/0033834 | A1 * | 2/2012 | Mellow | H03F 1/18 381/120 |
| 2012/0230524 | A1 * | 9/2012 | Chang | H04R 17/005 381/190 |
| 2012/0234818 | A1 * | 9/2012 | Martin | H04R 17/00 219/210 |
| 2013/0072834 | A1 * | 3/2013 | Afshar | A61H 1/00 601/46 |
| 2013/0108061 | A1 * | 5/2013 | Ando | G06F 3/0433 381/55 |
| 2013/0121509 | A1 * | 5/2013 | Hsu | H04R 19/005 381/104 |
| 2014/0140551 | A1 * | 5/2014 | Ramstein | H04R 17/005 381/182 |

* cited by examiner

TRANSDUCER SYSTEM

TECHNOLOGICAL FIELD

The invention relates to signal generating systems. In particular the invention is useful in the field of acoustic transducer systems.

BACKGROUND

Acoustic signals are typically generated by moving membranes causing pressure variations which results in propagation of acoustic waves. Speakers and speaker systems are often integrated into various electronic devices and may be constructed in different configurations to produce acoustic waves of audio-band frequency ranges.

Some types of speaker elements (acoustic transducers) utilize Piezo-electric materials to generate mechanical movement in response to electric field applied on the material. Many piezo-electric materials can provide mechanical movement at frequencies corresponding to acoustic frequencies (as well as other frequency ranges) and can be used to generate acoustic signals in the audio band and/or ultrasound ranges.

U.S. Pat. No. 6,427,017 discloses a piezoelectric diaphragm with a transparent piezoelectric member and a transparent electrode. Also disclosed is a portable electronic device that has a display means to display an image and a piezoelectric speaker having a transparent piezoelectric member and a transparent electrode. In this portable electronic device, the piezoelectric speaker is disposed in front of the display means.

US 2011/033,074 provides a transparent speaker which is suitable for being disposed on a display panel. The transparent speaker includes a transparent membrane, a transparent electrode plate, and spacers. Each transparent electrode plate has a plurality of openings. The display panel includes a plurality of pixels. The pixels emit optical signals. A Moire spatial period of the optical signals is less than 600 μm after the optical signals pass through the transparent speaker. When the transparent speaker is disposed on the display panel, a user is able to watch an image on the display panel through the transparent speaker without being interfered by a Moire.

US 2011/261,021 describes a haptic device including a substantially transparent composite piezoelectric cell configured to measure a deformation of a surface of the cell and to provide a haptic feedback effect as a result of the deformation. More specifically, US 2011/261,021 discloses a haptic device comprising: a substrate; and a substantially transparent composite piezoelectric cell overlaying the substrate, the piezoelectric cell comprising a sensor piezoelectric layer configured to generate a first signal when the sensor piezoelectric layer is deformed, and an actuator piezoelectric layer configured to provide a haptic effect upon receipt of a second signal that is based on the first signal.

GENERAL DESCRIPTION

There is a need in the art for a novel transducer system capable to be integrated into electronic and other devices with minimal use of vacant outer surface of the device. The front outer surface of many electronic devices today (e.g. handheld devices) are largely occupied by a display. Accordingly space/surface area for accommodating acoustic transducers in such devices is scarce and in many cases the acoustic transducers are located on the back side of the devices, which may result with low quality (blurred) sound when the device is laid on its backside. Also, due to size limitations in such devices, designers of such devices often compromise for small acoustic transducers which are in many cases associated with deteriorated sound quality as compared with transducers of larger dimensions. The present invention provides a flat, transparent and continuous transducer system (panel) which can be integrated/located over the display of electronic devices for generating and/or sensing acoustic/pressure fields.

The transducer system of the present invention is configured to produce acoustic signals of one or more frequency range and possibly also to enable controllable sound generation with respect to a listener location. Moreover, the transducer system of the present invention may also be capable of generating mechanical vibration and/or it may also be utilized as input system for sensing external pressure variations (acoustic/touch) applied to the surface of the transducer system.

The transducer system of the present invention is typically designed as a panel (e.g. flat and/or substantially thin panel) and comprises plurality of separately operable transducers arranged in predetermined geometry along a surface of the panel. This configuration of the transducer system enables integration of the transducer system into other devices (e.g. electronic devices) such that the transducer system may be located on (or integrated into) an outer surface of the device. Additionally, the transducer system of the present invention may be optically transparent with respect to visible light, to thereby enable integration of the transducer system with/onto a display surface of an electronic device, which otherwise would have not been usable other than being the display surface of the device. To this end, the transparent transducer system may be attached to or integrated into devices and located over the display surface of the device while allowing displayed images to be seen through the transducer system.

The transducer system of the present invention can be operated to generate mechanical vibrations of one or more frequency ranges. Similarly to speaker systems, these mechanical vibrations can generate pressure waves which propagate in air and provide acoustic signals. Thus, the transducer system may be operable as a speaker system providing acoustic signals in response to electric signals provided thereto.

To provide the relatively flat and thin form factor, the transducers systems employs an array/arrangement of plurality of smaller transducers (e.g. transducer regions on the panel). The characteristics of the transducers (e.g. size of the transducer and/or its structure) may be configured in accordance with the type/wavelength of the acoustic signals to be generated/sensed thereby and in accordance with the desired width of the acoustic beam generated/received thereby. For example, for a given transducer size, low frequency acoustic signals (long wavelength) will propagate in wider angle range relative to high frequency signals (short wavelength).

When the transducer system is operated to generate acoustic signals of relatively high frequencies (e.g. Ultra Sound frequencies) the plurality of transducers may be capable to generate a low-divergent acoustic signal, i.e. a signal which propagates with divergence of less than 15°, or at times less than 10°, and in some configurations even less than 5°. When generating acoustic signals of such high frequencies, the use of plurality of separately activated transducers by the system enables the transducer system to be operable based on certain sound generating algorithms to provide selected spatial distribution of a sound field generated therefrom by transmitting different acoustic signals using different transducers of the system. For example the transducer system of the present invention may be operated for generating spatially localized sound field in accordance with the technique disclosed in PCT patent application no. PCT/IL2013/050952 assigned to the assignee of the present application.

As indicated above, the transducer system of the present invention comprises a plurality of separately operable transducers, which are capable of generating vibrations in one or more frequency ranges. Preferably the separately operable transducers are configured such that vibrations of the transducers generate pressure waves which propagate in the air away from the transducer system. These pressure waves may be of one or more frequency ranges. For example the separately operable transducers may generate audio-band frequency acoustic wave, and/or generate acoustic wave of Ultra-Sound (US) frequencies. Such US frequencies may typically include acoustic waves having frequency of 40 KHz to 100 KHz. Additionally, vibrations of the separately operable transducers may be of lower frequencies and provide mechanical vibration which may be sensed by a human touching a surface of the system. Additionally, the transducers may bend and/or protrude to provide dome-like structures in response to DC voltage provided thereto to create bumps on the surface of the system. This may be used in various applications for example to increase efficiency in generating acoustic signals and/or to provide a physical form (e.g. relief pattern) to a virtual keyboard.

The transducer system of the invention may comprise one or more transducers, each comprising at least a region of an optically transparent panel and electrical contacts being electrically coupled to said panel at regions associated with the one or more transducers. The (acoustic) transducers are individually operable such that each one of the plurality of transducers can independently generate certain signal due to mechanical vibration (which may generate acoustic signal) which may be similar or not to signals generated by other transducers. To this end, the transducer system also includes a signal transmission arrangement (e.g. wiring network/assembly) including plurality of electric signal transmission lines (e.g. electric wires) which are electrically coupled to the plurality of acoustic transducers (to respective electrical contacts thereof). The signal transmission lines of the signal transmission arrangement are configured to transmit electric signals to individual transducers of the plurality of transducers thus enabling independent operation thereof.

The optically transparent panel typically comprises a piezo-electric material configured to expand or shrink/contract in response to electric fields applied thereto. It should be noted that the optically transparent panel may preferably be a continuous panel extending along the transducer system; the panel may be segmented to separate transducers (corresponding to regions of the panel) by the electric contacts which are coupled to different regions thereof. The transducer system also comprises a signal transmission arrangement (e.g. an electric wiring assembly) coupled to the electrical contacts and configured to provide electrical signals or to apply electrical voltage onto said transducers. Thus, when the electrical contacts apply voltage (or voltage variations) of their associated region of the transparent panel, the piezo-electric material of the panel expands or contracts. By providing alternating voltage of certain frequency to the electrical contacts, the piezo-electric material of the transducer can vibrate in said certain frequency and thus may generate acoustic signals.

Generally, the transducer system of the invention may be a stand-alone system or integrated into a parent device/system and configured to provide one or more of the following functionalities: generate mechanical vibrations of relatively low frequency, e.g. to provide sensation of vibration to a user; generate audio-band acoustic signals in ear-speaker mode and/or in loud-speaker mode as will be described further below; and generate ultrasonic acoustic signals, preferably of high Sound Pressure Level (SPL), e.g. of frequencies above 20 KHz, utilizing beam forming and steering techniques. Additionally, the piezo-electric material of the transparent panel may be utilized to generate electrical signal in response to external pressure applied thereto. These electrical signals may be collected by the electrical contacts associated with transducers of the transducer system and transmitted by the signal transmission arrangement for further use/processing. Thus the transducer system may also provide one or more of the following functionalities: generate electrical signals in response to external localized pressure, e.g. in the form of touchpad; generate electrical signals in response to acoustic waves impinging on surface of said transducer system, i.e. operate as a microphone; generate electric signals in response to acoustic waves of Ultra-sonic frequencies (US) which will be described in more details further below.

Thus according to a broad aspect of the present invention there is provided a transducer system comprising a panel comprising one or more piezo-electric sheets and an arrangement of electric contacts coupled to said panel and configured to define a plurality of transducers in said panel. Wherein one or more of the transducers is associated with a region of the panel and with at least two electric contacts coupled to at least two zones of said region and configured to enable provision of electric field in said at least two zones for simultaneously causing different degrees of piezo-electric material deformation in said zones to thereby deform said region of the panel in a direction perpendicular to a surface of said region, thereby enabling at least one of the following in said region: conversion of electrical signals to mechanical vibrations and conversion of mechanical vibrations to electrical signals. The electric contacts may be electrically coupled to at least one region along at least a top surface and a bottom surface of said one or more active layers. The piezo-electric material used may be configured as mono-oriented or bi-oriented piezo-electric material.

It should be noted that the phrase different degrees of deformation (e.g. of piezo-electric material deformation in different zones of a transducer region) may relate to different extents of the deformation (e.g. measured by dimensionless numbers representing change in per unit of length/surface-area/volume respectively) and/or to different rates of the deformation (e.g. extent of deformation per unit time). According to some embodiments such different zones are arranged laterally across the panel and/or vertically in the depth of the panel.

The different degrees of piezo-electric material deformation may be associated with piezo-electric material expansion in at least one of said zones and piezo-electric material contraction in at least one other of said zones.

According to some embodiments of the invention the plurality of transducers are arranges in a predetermined geometry and spacing along the panel. The transducer system may comprise a signal transmission arrangement coupled to the electric contacts and configured to provide electric connection thereto to independently operate said transducers for generating mechanical vibrations in one or more frequency ranges in response to electric signals provided thereto by said signal transmission arrangement.

According to some embodiments of the present invention the transducer system (e.g. the panel thereof) is optically transparent to visible light. For example, the one or more piezo-electric sheets and possibly passive polymer foils of the panel may be substantially optically transparent to visible light, and may be formed utilizing substantially transparent piezo-electric materials (e.g. transparent piezo-electric polymers). Also, the electric contacts electrically connected to the plurality of transducers elements of the panel, may be configured as optically transparent electric contacts. The electric contacts may be formed for example by utilizing substantially transparent conductive materials and/or by utilizing a substantially transparent conductive mesh formed with thin conductive elements/wires.

The transducers may be operable for generating mechanical vibrations in one or more acoustic frequency ranges to thereby generate acoustic signals of said one or more acoustic frequency ranges. Said one or more acoustic frequency ranges may comprise at least one of audio-band frequency range and ultra-sound frequency range.

According to some embodiments of the invention the panel may comprise one or more layers comprising one or more active layers formed with piezo-electric material capable of deforming in response to electric signals applied thereto to thereby generate said mechanical vibrations. The panel may also comprise at least one passive layer mechanically coupled to said one or more active layers in predetermined locations defined by said predetermined geometry, such that expansion and contraction of the respective zones in said region of the panel provides deformation of said region in a predetermined direction perpendicular to said surface.

According to some embodiments of the invention said one or more active layers may comprise at least two active layers. Each of said at least two active layers may be formed with piezo-electric material capable of deforming in response to electric signals applied thereto. A region of said at least one transducer may comprise two or more electric contacts electrically coupled to said at least two active layers in said region; said two or more electric contacts are configured to apply electric field in said region such as to expand a zone of one of said at least two active layers in said region and contract a zone of one other of said at least two layers in said region to thereby deform said region in a predetermined direction perpendicular to said surface.

Said at least two active layers may be formed by sheets of piezo-electric material with opposite polarities, said two or more electric contacts comprise two electric contacts located in opposite sides of said at least two active layers and configured to generate electric field therebetween such that in response to electric field of a certain direction provided by said two electric contacts, at least one of said active layers expands and at least one other contracts. Alternatively, said two or more active layers formed by sheets of piezo-electric material may be configured with similar polarities, said two or more electric contacts comprise two electric contacts located in opposite sides of said at least two active layers and a third electric contact located between said two or more active layers such that provision of electric field in opposite directions between said third electric contact and either one of said two electric contacts causes at least one of said active layers expands and at least one other contracts.

According to some embodiments the panel may comprise at least one active layer and wherein said at least two electric contacts comprising: at least a first and a second electric contacts electrically coupled to respectively a periphery and a central zones of said region of the panel on a surface of the said at least one active layer; and at least a third electric contact electrically coupled to an opposite surface of said at least one active layer; thereby enabling opposite expansion and contraction of said periphery and central zones of said region of the panel.

According to some embodiments the region of the panel associated with a transducer may be configured with a predetermined curvature along at least one axis parallel to said panel, such that expansion and contraction of respective zones of said region provide deformation of the panel in said region in a predetermined direction perpendicular to said panel.

Generally, at least some of said separately activated transducers may be capable of converting external pressure to an electric signal. Moreover, at least one or more transducers of said plurality of separately activated transducers may be capable of generating appropriate electric signals in response to external pressure applied thereto and provide said appropriate electric signal via its respective electric contacts to be transmitted by said signal transmission arrangement. Said at least one or more transducers are preferably capable of generating said appropriate electric signal in accordance with frequency of said external pressure. More specifically, said plurality of separately activated transducers may be capable of generating electric signals in response to acoustic waves of certain frequency ranges arriving thereto, and said frequency ranges may comprise one or more of the following: audible frequencies and Ultra-Sound frequencies, thereby enabling operation of said transducer system as a microphone.

It should be noted that according to some embodiments of the invention, the panel includes at least one active layer of piezo-electric sheet comprising a polymer piezo-electric sheet. Said polymer piezo-electric sheet may extend along the surface of the transducer system covering regions of at least two transducers, and may extend along the entire surface of the transducer system. The polymer piezo-electric sheet may comprise PolyVinyliDene Fluoride (PVDF) based material, for example, such as PVDF-trifluoroethylene (P(VDF-TrFE)), PVDF-trifluoroethylene-chlorotrifluoroethylene (P(VDF-TrFE-CTFE)).

According to some embodiments, the electric contacts of the acoustic transducer system may comprise thin metallic mesh. Additionally or alternatively, the electric contacts on said optically transparent panel may comprise at least one of the following: (i) Carbon Nano-Tubes (CNT) thin coating; (ii) Graphene coating; (iii) Silver (Ag) nano-particles coating; (iv) Indium Tin Oxide (ITO) ultra thin coating; (v) Polyaniline transparent coating; (vi) Polythiophene transparent coating; and (vii) Poly(3,4-ethylenedioxythiophene)-poly(tryrenesulfonate) (PEDOT/PSS) transparent coating.

The separately activated transducers of the transducer system may be arranged in a predetermined geometry and spacing between them. The transducer system may comprise transducers arranged in at least one of the following geometries: (i) Cartesian array; (ii) annular spherical rings; and (iii) hexagonal array.

According to some embodiments of the invention, the transducer system may be associated with a control unit connectable to said plurality of separately activated transducers via said signal transmission arrangement, and configured and operable to selectively operate each of said plurality of separately activated transducers. The control unit may be configured and operable to receive electric signals from said plurality of separately activated transducers, and to identify location of a source of said electric signals in said transducer system.

According to yet another broad aspect of the present invention there is provided an electronic device comprising the transducer system as described above and a control unit. The control unit is connectable to said signal transmission arrangement and configured to selectively provide electric signals through said signal transmission arrangement to selected electric contacts of selected transducers, to thereby generate acoustic signals in accordance with data indicative thereof received by said control unit. The electronic device may be configured as a hand held electronic device.

The electronic device may include a display unit. The transducer system may be configured to be transparent to visible light and located on top of said display unit. Alternatively or additionally the electronic device may include a display unit, and the panel of the transducer system is furnished at one or more regions surrounding the display unit, for example located at one or more regions of the device at the frame of the display unit, or surrounding other existing element such as a smartphone device in a docking station configuration, or alternately in a totally different plane such as in the keyboard plane as in laptop device.

The signal transmission arrangement may be configured such that wires transmitting electric signals to and from electric contacts of selected transducers are aligned along a surface above said display unit such that said wired being aligned to pass between pixels of said display unit to thereby leave pixels area free of obstacles.

The transducer system may be operable as at least one of a touch pad and a microphone and the control unit may be configured to receive electric signals indicative of external pressure applied to one or more of said separately activated transducers.

According to some embodiments electric signals received from said electrode assembly may be indicative of at least one of the following: a user interaction applying external pressure to one or more of said transducers, and acoustic waves received by one or more of said transducers.

According to yet another broad aspect of the present invention there is provided an electronic device comprising a transducer system and an associated control unit. The transducer system comprises plurality of transducers arranged with a predetermined geometry along an outer surface of said electronic device and a signal transmission arrangement connecting said plurality of transducers to said control unit and enabling separate operation of different transducers of said plurality of transducers, wherein said plurality of transducers are configured to generate mechanical vibrations of one or more predetermined frequency ranges in response to electric signals provided thereto by the control unit.

The electronic device may include a display unit connectable to said control unit, and the transducer system may be configured to be transparent to light of the visible spectrum and is located on top of said display unit. Alternatively or additionally the electronic device may include a display unit, and the panel of the transducer system is furnished at one or more regions surrounding the display unit, for example located at one or more regions of the device at the frame of the display unit, or surrounding other existing element such as a smartphone device in a docking station configuration, or alternately in a totally different plane such as in the keyboard plane as in laptop device.

According to yet another broad aspect, the present invention provides a transducer system comprising a plurality of separately activated transducers arranges in a predetermined geometry and spacing at respective regions on a surface of a panel, and a signal transmission arrangement coupled to said plurality of separately activated transducers and configured to provide electric connection thereto said transducers. Said panel comprises: at least one active layer of piezo-electric material and at least one additional layer coupled to said at least one layer of piezo-electric material to form a bi-morph piezo-electric sheet in at least one region of said regions being associated with a transducer; and said signal transmission arrangement comprises one or more electric contacts electrically coupled to said active layer at said region and wherein configuration of said bi-morph piezo-electric sheet and said electric contacts is operable for deforming said region towards a predetermined direction substantially perpendicular to said surface in response to application of predetermined electric field in said region by said electric contacts. The additional layer may be at least one of the following: a second active layer comprising piezo-electric material and a passive layer.

It should be noted that the term bi-morph (e.g. bi-morph configuration of a transducer region and/or panel) relates to a configuration of two or more layers in the panel/transducer region which are coupled/attached together such that each of the layers in the region may deform to a different degree in response to electric signal applied thereto. The bi-morph configuration may include for example an active (piezo-electric) layer and an additional layer attached thereto which may be active layer or passive layer (e.g. with no piezo-electric properties).

According to some embodiments of the present invention, in an inoperative state said surface of the panel may have substantially flat geometry and wherein operation of said transducer is associated with provision of a bias potential to the one or more electric contacts to deform said region of the transducer to form a curved surface protruding in said predetermined direction.

Operation of said transducer for generating mechanical vibrations in a certain frequency may be associated with providing at least one of said electric contacts with alternating potential oscillating with said frequency.

The transducer system may be configured and operable for converting mechanical pressure applied to the curved surface into corresponding electric potential on at least one of said electric contacts.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 1A illustrates a transducer system and FIG. 1B exemplifies a region of the panel associated with one transducer;

FIG. 2A illustrates a configuration, FIG. 2B illustrates a transducer configuration configured with an active layer anchored to a substrate; FIG. 2C illustrates a bi-morph transducer configuration utilizing a passive and active layers coupled together.

DETAILED DESCRIPTION OF EMBODIMENTS

Figure 1A:
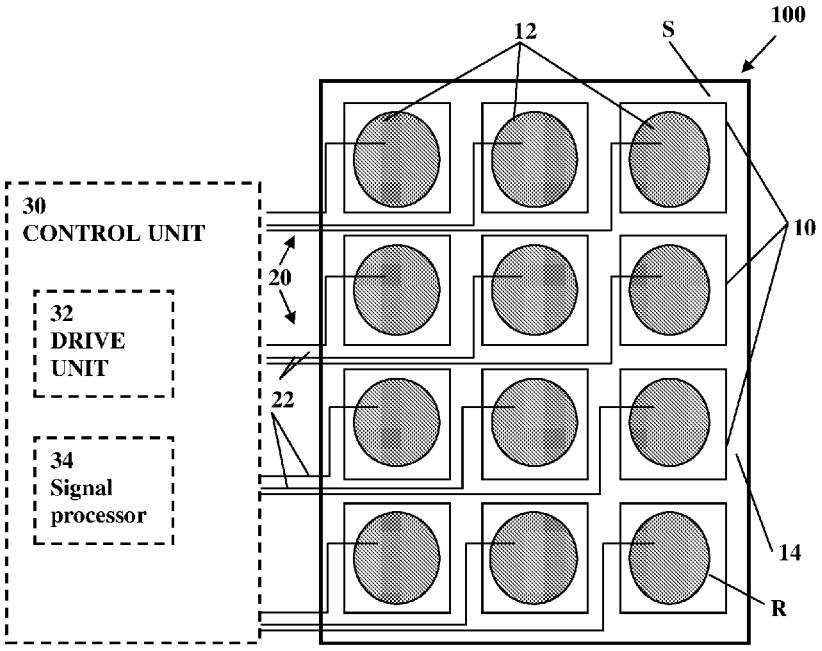
FIGS. 1A and 1B schematically illustrate a transducer system according to the present invention.

The present invention provides a transducer system, capable to be integrated into various devices, and configured to provide output signals in the form of mechanical vibrations and/or acoustic signals in accordance with operation of the device. Reference is made to FIG. 1A illustrating a transducer system 100 according to the invention. The transducer system 100 includes a plurality of transducers 10 arranged in a predetermined geometry and spacing. The transducers 10 are generally piezo-electric transducers configured and operable for converting mechanical pressure/deformation (e.g. associated with acoustic waves and/or touch) into electrical signals and/or vice-versa. The transducer system 100 also includes a signal transmission arrangement 20 connected to the transducers 10 and configured to enable individual operation of each transducer 10.

The transducer system 100 includes a panel 14 including one or more piezo-electric sheets (e.g. layers of piezo-electric material composition). Also the transducer system 100 includes an arrangement of electric contacts 12 (e.g. electrodes) coupled to the panel 14.

In some embodiments the piezo-electric sheet(s) of the panel 14, and possibly also other passive layers of the panel (e.g. passive (non-piezoelectric) polymer foils and/or adhesive layers), are substantially optically transparent to visible light. In such embodiments, the electric contacts are preferably configured to be optically transparent electric contacts.

The shapes and arrangement of the electric contacts 12 are configured to define a plurality of transducers 10 in the panel 14, i.e. the electric contacts may define the transducer units in the meaning that an area covered by an electric contact is the area of its associated transducer. According to some embodiments of the present invention one or more transducers 10 are laterally arranged on the same/single panel 14 while the locations/arrangement of the electric contacts 12 on the panel 14 practically define the locations/shapes of the transducers. For example the electric contacts 12 may be arranged to define the region R of the each transducer 10.

Figure 1B:
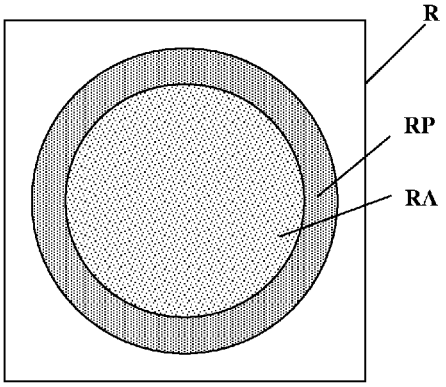

FIG. 1B illustrates a region R of the transducer 10 in more details to show the active region RA of the transducer 10 and the periphery region RP thereof. The active region RA of the transducer 10 operates as the main membrane region of the transducer for generating and/or sensing acoustic/pressure signals (e.g. active region RA substantially protrudes from the surface S and/or vibrates during the operation of the transducer 10). The periphery region RP typically encloses the active region RA and operates as the main driving region for actuating the active region RA for generating acoustic signals and/or electrical signals in touch sensing operation (e.g. during operation of the transducer 10 the periphery region RP deforms to push/pull the active region RA with respect to the surface S). To this end, the region R of the transducer 10 is defined by the arrangement of the electrodes 12 in the panel 14. It should be noted as the panel is typically formed as continuous sheet, it should also be noted that there may or not be a clear/distinctive boundary between the active and periphery regions RA and RP. Nevertheless, in some embodiments of the present invention these regions are associated-with/defined-by specific lateral arrangement of the electrodes 12 in the region R of transducer 10 which is aimed at improving the efficiency and/or dynamic range of the transducer 10 (see for example FIGS. 4A and 4B below). Alternatively or additionally, these regions may be associated with spatial discontinuities/cuts which are located at one or both of these regions in one or more layers of the panel 14 (see for example FIGS. 3B and 5B below).

To this end, in the panel 14 there are one or more transducers 10 (typically a plurality of transducers) wherein each transducer 10 is associated with a respective region R of the panel 14. Also, each transducer 10 is associated with at least two electric contacts 12 which are coupled to at least two locations/zones of the respective panel region R associated with the transducer 10, generally, each transducer is associated with at least one dedicated electric contact and at least one other electric contact which may be dedicated to this transducer or not. FIG. 1A shows the top surface of the panel 14 with one such electric contact 12 located thereon (generally additional electric contacts 12 may be on top and/or bottom surfaces of the panel and/or arranged in intermediate layers in the panel 14). As generally known, Piezo-electric materials deform/vary their physical dimensions in response to variations of electric field. The transducers 10 in the present example are defined by the region R of a piezo-electric sheet associated with the panel 14 and coupled to the electric contacts 12. The locations and shapes of the electric contacts associated with each transducer define region(s) where electric field variations cause the piezo-electric sheet to expand/contract and accordingly segment the panel to individually operated transducers. Generally, each transducer is associated with at least one dedicated electric contact 12 and with at least one additional electric contact which may or may not be common to other transducers as well. In some embodiments, a transducer 10 may include more than two electric contacts 12 as will be described further below. Alternatively or additionally, in some configurations, several transducers 10 may share an electric contact 12, being operated as ground contact.

According to some embodiments of the present invention, the shapes and/or locations of the at least two electric contacts 12 are configured to enable simultaneous piezo-electric material expansion/contraction (generally deformation) with different material deformation degrees at different zones of the panel region R associated with the transducer 10. For example the at least two electric contacts 12 enable simultaneous piezo-electric material expansion in at least one zone of the panel region associated with the transducer 10 and piezo-electric material contraction in at least one other zone of the panel region associated with the transducer 10. In this regard, the terms different expansion/contraction of different zones should be understood in the broader sense as relating generally to different degrees of material deformation (with different magnitudes of the same and/or different signs/directions of the material deformation). This feature of the inventions provides for deforming the region of the panel such that at least a part of the region R protrudes outwards (e.g. in a direction substantially perpendicular to the panel's surface S). Accordingly, the region of the panel associated with the transducer 10 (or at least an "active" part RA thereof which associated with the protrusion) is operable as an acoustic membrane for converting of electrical signals to mechanical/acoustic vibrations and/or conversion of mechanical/acoustic vibrations to electrical signals. The simultaneous material deformation to different degrees (e.g. expansion and contraction) at different zones in the panel region R (achieved by the spatial arrangement and shapes of the at least two electrodes in that region) result in efficient conversion between mechanical and electrical signals and/or vice versa (these conversions are commonly and/or alternatively referred to herein as electrical-mechanical conversion). Efficiency of the electrical mechanical conversion is obtained by enabling control of the curvature of the region R while reducing or eliminating tensions/stresses in the panel region R while forming the desired curvature. Specifically, this efficient electrical-mechanical conversion provides at least one of the following: efficient generation of pressure/acoustic waves (e.g. with high electrical to mechanical/acoustical conversion ratios enabling the transducer to generate acoustic waves with sufficient sound pressure level (SPL) (e.g. of about 65-85 dB at predetermined frequency ranges), and/or with efficient conversion between pressure/acoustic waves to electrical signals, e.g. associated with low signal to noise (SNR) and/or high sensitivity.

In some embodiments described in more details below (see FIGS. 3A and 3B and related description for example), a bi-morph panel configuration is exemplified in which the panel 14 includes at least two piezo-electric layers/sheets co-planarly coupled to form a bi-morph piezoelectric sheet. The at least two electrodes (electric contacts) 12 include at least two electrodes arranged in a transducer region R of the panel 14 on at least from both sides of the bi-morph piezoelectric sheet. The electrodes 12 are configured to enable simultaneous expansion and contraction of respective layers of the bi-morph (which layers form/constitute the different contracting and expanding zones of each transducer region R). The expansion of one piezo-electric layer simultaneously with the contraction of another piezo-electric layer coupled thereto provides for efficient actuation of at least a central part of the transducer region R (functioning as the transducer's membrane) along a general axis/direction substantially perpendicular to the panel's surface S. To this end, the different simultaneously contracting and expanding zones are associated in this example with vertically stacked layers of the bi-morph sheet.

In some embodiments which are also described in more details below (see FIGS. 4A and 4B and related description), each (or at least some) transducer region is associated with lateral arrangement of at least two zones and is configured and operable to enable expansion of at least one of the lateral zones simultaneously with contraction of at least one other lateral zone. Specifically, according to some embodiments, the panel 14 includes at least one piezo-electric sheet/layer (optionally a bi-morph or a single layer) and the arrangement of electric contacts includes at least two electric contacts arranged laterally being coupled to the transducer region R the panel 14 from one side of the piezo-electric layer, and at least a third electric contact coupled from the other side of the piezo-electric layer. The at least two electric contacts include one or more central electric contact associated with a central zone of the transducer region R and one or more peripheral electric contacts associated with a periphery zone of the transducer region. The electric contacts 12 are arranged to enables provision of respective electric fields in these central and periphery zones to deform the respective zones to various degrees and thereby efficiently actuate at least the central zone in a general direction perpendicular to the panel's surface.

According to some embodiments of the present invention the transducer system 100 has an panel 14 which, in its in-operative state, has a substantially flat geometry. The panel 14 includes a plurality of separately activated transducers 10 arranges in a predetermined geometry and spacing at respective regions thereof. In a region R of at least one of the transducers, the panel 14 includes at least a part of an active layer of piezo-electric material (e.g. material composition with piezo-electric properties) and at least one additional layer coupled to the active layer to form a bi-morph piezo-electric sheet. One or more electric contacts 12 are electrically coupled to the bi-morph piezo-electric sheet at the transducer's region R and are configured and operable for applying electric field in that region R to cause deformation/protrusion of the region R towards a predetermined direction substantially perpendicular to the surface S of the panel 14. In other words, the bi-morph configuration of the panel is associated with a preferred direction towards which the transducer regions R deform when proper electric fields are applied thereto. In this connection, the panel 14 may include a bi-morph of two or more active layers (e.g. the additional layer being also active layer formed with piezo-electric material), or the panel 14 may include a bi-morph of an active layer and a passive layer (e.g. the additional layer being passive layer formed for example of non-piezoelectric polymer/hard-substrate.

The configuration of transducer system 100 according to these embodiments of the present invention is associated with a substantially flat panel (which may be substantially transparent) operable of generating and/or sensing pressure/acoustic fields/signals. These features of the transducer system 100 and panel 14 make it suitable for use as an overlay of a display panel/screen (e.g. for use with liquid crystal displays (LCDs) of portable handheld devices) for providing functionality such as touch-sensing and/or haptic feedback and/or sound generation/reception. The flat geometry of the panel 14 is associated with low or no optical aberrations which do not distort optical display through the panel 14. Also a plurality of transducers 10 are defined by the arrangement of electrodes 12 (which may be substantially transparent) on the panel 14 and the single "continuous" panel may thus serve for arranging the plurality of transducers 10 thereon without any physical separation/cut/division between the transducers.

As noted above, in an inoperative state the surface of the panel 14 is substantially flat. According to some embodiments, operation of a transducer is associated with provision of a bias potential to one or more electric contacts 12 coupled to the region R of the transducer 10, to deform that region R and form a curved surface protruding in a predetermined direction. In case the transducer 10 is operated for generating mechanical vibrations (e.g. acoustic waves) in a certain frequency, in addition to the bias potential, the electric contacts 12 (or one of them) are provided with alternating potential oscillating at the desired frequency thus causing the curved surface to oscillate in that frequency (e.g. to behave as an oscillating dome/membrane). In cases where the transducer 12 is operable for converting mechanical pressure (e.g. touch/sound) to electrical signals, the pressure applied to the curved surface is converted due to the piezoelectric properties of the panel 14, into corresponding electric potential on at least one of the electric contacts 12.

It should be noted that although the transducers 10 are shown in FIG. 1A as rectangular transducers, the transducer system 100 of the present invention may utilize transducers 10 of various geometrical shapes. It should also be noted that generally similarly or differently shaped transducers may be used. The transducers 10 may be circular (as exemplified in FIG. 1B), rectangular or hexagonal transducers, or be configured in any other geometrical shapes. Additionally the transducers 10 are typically arranged along the surface of the system in an array having any desired geometry, for example the transducers 10 may be arranged in a Cartesian array, Hexagonal array, circular/annular concentric rings or in any other suitable array geometry.

As noted above each transducer 10 includes at least a region R of a panel 14, and electric contacts 12 electrically coupled to the region R of the panel (typically from top and bottom sides of that region R). The panel 14 may be formed with piezo-electric sheet(s) including one or more layers of piezo-electric materials. According to some embodiments, the panel 14 may include a polymer piezo-electric sheet/layer extending along the surface S of the transducer system 100 and wherein the separate transducers 10 are defined by the electric contacts 12 coupled to the regions (e.g. R) of the panel 14. It should be noted that typically, the piezo-electric material of the panel (piezo-electric sheet) deforms upon application of electric field thereon. This characteristic of the piezo-electric material results in that the transducers 10 of the system 100 are typically defined by the region R coupled to the electric contacts 12. According to some embodiments the shape and area of an electric contact 12 which are associated with a selected transducer 10, actually define the shape and size of the active area of the transducer 10.

The electric contacts 12 of each of the transducers 10, are connectable or connected to corresponding conductive transmission lines 22 (e.g. wires) of the signal transmission arrangement 20 to enable provision/receipt of electric signals to and/or from the transducers 10 to independently operate the transducers 10. According to some embodiments, the panel 14 and the electric contacts 12 are configured to be a transparent to visible light. To this end the electrical contacts 12 may be formed with transparent electrically conductive material and or formed utilizing a substantially transparent mesh of thin wires as will be further described below. Additionally, the signal transmission arrangement 20 (including conductive transmission lines 22) is made of transparent electrically conductive material and/or utilizing thin wires (e.g. having thickness of 2-3 μm, 5-10 μm, or 10-25 μm). Alternatively or additionally, the conductive transmission lines 22 (or some of them) are routed at regions of the transducer system 100 at which transparency is not required (e.g. along edges of pixels of a predetermined display system to be attached below the panel 14). Accordingly, the panel 14 is configured to substantially not obscure light transmission therethrough, to thereby provide practically transparent transducer system 100.

It should be noted, that for clarity the term electric wires is used herein below to refer to the conductive transmission lines 22 and generally is to be interpreted broadly to include any type of conductive transmission lines including electric wires, printed conductive circuits and/or any other suitable electric transmission technology.

The wires 22 of the signal transmission arrangement 20 as well as the electric contacts 12 may be configured with appropriate impedance to enable transmission of high-frequency electric signals without any significant interference due to self- or mutual-inductance and capacitance. Additionally, the signal transmission arrangement 20 may include one or more radio-frequency (RF) filters (not specifically shown here) configured to provide RF shielding to electric signals transmitted to and from the transducers 10 of the system 100.

As shown in FIG. 1, the transducer system 100 may be associated with a control unit 30 connectable to the wires 22 of the signal transmission arrangement 20. The control unit 30 may include a computerized system and/or an analogue system and may be adapted for processing signals to be received-from/transmitted-to the transducer system 100. In the present example, a signal processor 34 (e.g. including digital processing unit and/or digital-to-analogue convertor (DAC)) is used for processing signals received/transmitted to the different transducers 10 of system 100. Also a drive/filtration unit 32 (e.g. analogue signal amplifier) may be included in control unit 30 for transmitting/receiving analogue electrical signals to the different transducers 10 of the system 100. Additionally, the control unit may include, or be associated with, various additional utilities/modules such as: connecting wires/harness, analog and digital combined front-end integrated circuit(s), DSP and processor chips, an audio-band and/or ultrasound sensitive microphone, one or more speakers, wide-angle lens camera, infra-red sensitive camera, and other utilities/modules required for operation of the control unit and/or an associated electronic device. The control unit 30 may operate the transducer system 100 to produce mechanical vibrations and/or acoustic signals and/or to be responsive to corresponding electric signals generated by different transducers 10 in response pressure variations (e.g. acoustic fields and/or physical contact) sensed thereby. It should be noted that in certain embodiments of the present invention, the control unit 30 may be configured and operable to provide bias voltages to the transducers 10 (e.g. individually and/or commonly thereto) in order to deform the regions R of the transducers to form a dome like/membrane structure operative for receiving and/or generating mechanical/acoustic signals.

The control unit 30 may be configured and operable to operate the different transducers 10 of the system by transferring/receiving signals via corresponding wires 22 of the signal transmission arrangement 20 to operate individual transducers 10. To this end, the operational modes of the control unit 30 will not be described in details herein, but to note that the control unit 30 may be capable of operating different transducers 10 of the system 100 individually and to provide/collect electric signals of one or more frequency ranges (e.g. audio and/or ultrasound frequency ranges). Also, in some case the control unit 30 may be operable for utilizing the plurality of transducers 10 for beam-forming signals to be received/transmitted from certain one or more directions (e.g. controlling/managing the relative phases associated with different transducers). The control unit 30 may be a part of an electronic device associated with the transducer system 100.

According to some embodiments of the present invention the transducer system 100 may be based on a sheet of piezo-electric material and a plurality of electric contacts 12 attached to the sheet to define the plurality of regions corresponding to the transducers 10. By applying electric potential on the contacts 12 associated with (coupled to) a selected region the piezo-electric material at the region expands and/or contracts (according to the direction of the potential with respect to polarity of the piezo-electric material and configuration of the electric contacts). In order to operate the selected transducer 10, the associated control unit 30 may provide an alternating electric potential of a selected frequency and form (e.g. in addition to DC bias voltage). When the control unit 30 provides an alternating potential to electric contacts 12 of a selected transducer 10 (via the corresponding wires), the portion of the piezo-electric material at the region of the contacts 12 contracts and expands in accordance with the electric potential to generate mechanical vibrations and/or pressure waves, e.g. forming acoustic signals, of the corresponding frequency.

Additionally, the piezo-electric material of the panel may be responsive to external pressure and generate corresponding electric potential between the electric contacts 12 of one or more of the transducers 10. This effect provides the transducer system with the ability to operate as input utility being responsive to touch or to acoustic signals and generate appropriate electric signals to be collected by the signal transmission arrangement 20. The control unit 30 may be configured to collect these appropriate electrical signals from the electrical wiring assembly 20 and to analyze these signals as being indicative of physical contact on a region of the transducer system 100 or as being indicative of acoustic signals in vicinity of the transducer system 100.

As noted above, the panel 14 includes one or more piezo-electric layers/sheets of polymer treated to have piezo-electric properties. The layers/sheets may be formed of piezo-electric material compositions, such as piezo-electric polymers. For example, to provide a transparent panel, materials such as treated PolyViniliDene Fluoride (PVDF) and/or co-polymer variation of PVDF (e.g. PVDF-trifluoroethylene (P(VDF-TrFE)); PVDF-trifluoroethylene-chlorotrifluoroethylene (P(VDF-TrFE-CTFE))) may be used. However any piezo-electric materials/polymers may be suitable for the purposes of the present invention.

In some embodiments, the piezo-electric sheet is optically transparent. For simplicity the term PVDF is used herein below referring to all types of piezo-electric PVDF-based polymer and also other transparent piezo-electric polymers. Such polymer sheets are typically stretched, annealed and undergo field polarization to provide piezo-electric properties of the polymer sheet. The PVDF sheets (and alike) are mostly of bi-oriented type, i.e. provide conversion of electrical field to mechanical expansion in both longitude (X) and transverse (Y) directions along the sheet equally, although in some embodiments mono-oriented, i.e. expand mainly along one axis, is possible. PVDF based materials are typically transparent in the visible spectrum, and have high mechanical strength, stability and UV light immunity. These characteristics allow the use of PVDF sheets as laminated foils on device's screen according to embodiments of the present invention.

As noted above, to provide transparency of the transducer system 100 (panel 14), the electric contacts 12 of the plurality of transducers 10 are preferably made of transparent electrically-conductive material and/or as a mash of thin conductive electric lines (being transparent or not). The electric contacts 12 may be located on one or both sides of the panel 14, and/or between layers/sheets of the panel 14 to be coupled to a piezo-electric layer of the panel. Generally, the electric contacts are configured as thin layer coating on regions of the panel 14 in accordance with the arrangement of the transducers 10. The electric contacts may include coating of one or more of the following materials: thin metallic mesh; carbon nano-tubes (CNT) or graphene coating, being plane carbon coating or overcoated with Copper (Cu); Silver (Ag) nano-particles coating; Indium Tin Oxide (ITO) coating (which may preferably be in the form of plurality of thin layers to preserve flexibility of the piezo-electric material); Polyaniline coating; Polythiophene coating; and Poly(3,4-ethylenedioxythiophene) poly(styrenesulfonate) (PEDOT/PSS) coating. It should be noted that the coating providing the electric contacts should preferably enable at least some elasticity of the contacts. This is to allow movement of the piezo-electric material of the panel in a selected frequency.

Figure 2A:
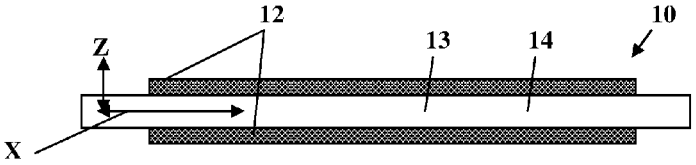
FIGS. 2A-2C exemplify several configurations of a transducer suitable for use in a transducer system of the present invention.
Figure 2B:
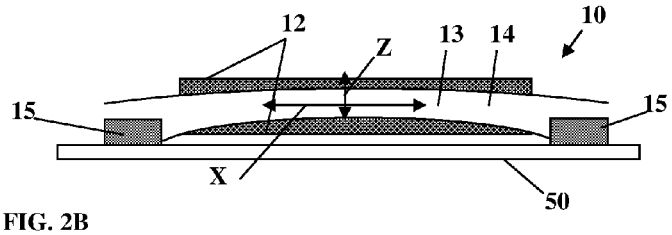
Figure 2C:
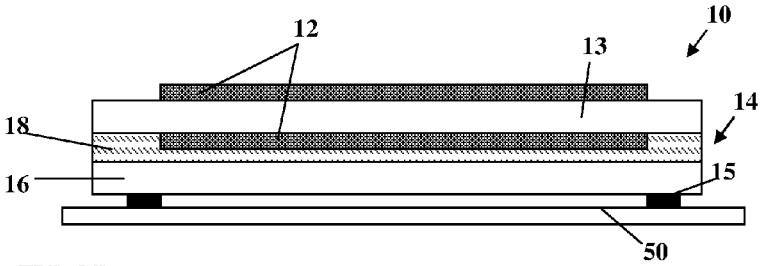

Reference is now made to FIGS. 2A-2C schematically illustrating several examples of single transducer 10 structures according to some embodiments of the present invention wherein a multiplicity of such element may be arranged on a single panel 14 to form a continuous arrangement of transducers, which are also configured as transparent transducers in certain embodiments of the invention. FIG. 2A shows a configuration of a planar transducer element and FIGS. 2B-2C illustrate two modification designed to improve the acoustic signal generation efficiency.

FIG. 2A shows a partial side view of panel 14 including a transducer 10 configured according to some embodiments of the present invention. The transducer 10 is based on a region of a panel 14 defined by location of at least one electric contact 12 (e.g. the phase contact in a case of phase-ground electric scheme in which the ground contact may be common to several transducers). The panel 14 may be a single layer formed from a sheet of piezo-electric material 13 (e.g. PVDF sheet), or it may be a multi-layer structure including one or more active layers having piezo-electric properties 13. The piezo-electric properties of the sheet(s) 13 (being at least a part of the panel) enable conversion of electric signals provided through the electric contacts 12 into mechanical movement of the corresponding region of the panel 14.

As generally known, piezo-electric sheets typically expand/contract in accordance with electric field applied thereto in proportion to the length of the sheet. The expansion of the piezo-electric material of the panel is therefore greater along the surface of the panel relative to expansion in the thickness dimension of the panel, i.e. greater along X (and Y) axes relative to the Z. This may result in substantial mechanical vibrations of the transducer 10 along the lateral (X-Y) plane but with poor mechanical vibrations in the Z direction and thus limited generation/sensing of acoustic waves.

To provide efficient conversion of electric signals to acoustic signals the transducers 10 are preferably configured such that the region of the panel 14 associated with transducer 10 is configured to deform/protrude in a predetermined direction (Z) substantially perpendicular to the surface S of the panel 14 in response to electric signal provided by the electric contacts 12. Two such configurations are illustrated for example in FIGS. 2B-2C. These configurations of a transducer 10 are designed to generate acoustic signals propagating substantially perpendicular to the surface of the transducer system. This is achieved by an appropriate configuration of the layers of the panel 14 such that upon expansion of the piezo-electric material at a region of a specific transducer, the panel 14, or some of its layers form a dome-like structure. This dome-like structure can be maintained over time by applying appropriate continuous DC voltage on a region of one or more transducers 10 and/or utilized for generating acoustic signals propagating away from the surface of the transducer system by providing appropriate AC voltage to the desired transducers. It should be noted that an alternating electrical signal may or may not be combined with a constant DC voltage. For example in sensing operation, the DC bias signal may be provided by the control unit 30 to form the dome like structure, and an additional signal (e.g. modulated/AC signal) may be generated by the transducer in response to pressure or acoustic signal of a certain frequency applied/sensed by the transducer. The additional signal may then be received by the control unit and further analyzed to determine the acoustics/pressure sensed by the transducer.

FIG. 2B shows a partial side view of a panel 14, including region of a transducer 10, configured according to some embodiments of the present invention. In this example, the region of the panel 14 of selected one or more transducers 10 is attached to a base panel (e.g. stiff substrate layer/panel) 50 by bonding material 15 at the edges of the region. Additionally, the active layer 13 of the panel 14 may be a priori configured with a curvature with respect to one or two of the lateral axes (X, Y) and/or it may be configured to curve with respect to these axes upon application of proper potential to the electrical contacts 12 (in this figure the panel is shown to be curved along the X axis) to form an arc or a dome-like structure of the transducers 10. This curvature of the panel 14 at the region of the transducer provides that expansion of the piezo-electric material in one or more lateral axes increases the curvature and pushes air along the transverse axis (away from the surface of the panel, Z axis). When the piezo-electric material contracts, the curvature reduces and the surface of the panel shifts/retracts in the opposite direction of the Z axis. In this configuration of the transducers 10, alternating voltage at an appropriate frequency will generate acoustic waves propagating away from the surface of the transducer system in a similar manner to a speaker.

It should be noted that in various embodiments of the present invention, the panel 14 and/or one or more of its layers (e.g. active layers/PVDF sheets) are pre-deformed having an inclination to expand in a specific direction substantially perpendicular to the panel's surface. This feature of the invention, which is specifically illustrated in FIG. 2B, may be implements in all configurations of the transducer system of the invention described herein.

In embodiments where the transducer is configured to be transparent and in order to reduce and/or eliminate optical aberrations/distortions, the bonding material 15 used may be a transparent material having refractive index substantially similar to that of the panel, and/or it may be located in regions of the panel in which light transmission in not required, e.g. in between pixels. Also in cases where active layer is a priori curved, the panel 14 may be immersed in an electrically isolating solution having substantially similar refractive index in order to reduce refraction of light due to the curvature of the panel 14.

FIG. 2C exemplifies a part of panel 14 including a transducer 10 configured according to one other embodiments of the invention. In this example, the panel 14 is a multi-layer structure including at least one active layer 13 having piezo-electric properties and a passive (non-piezo-electric) layer 16 being a flexible layer. In this example, the panel 14 is conjured as a bi-morph of passive and active layers wherein the active layer 13 is attached to the passive layer 16 along an interface 18 between the layers, e.g. by a bonding layer/material 18. According to some embodiments of the present invention the active 13 and passive 16 layers, and, as well as the bonding layer in interface 18 are substantially transparent to visible light and extend continuously throughout multiple transducer regions in the panel 14.

Upon application of proper electric voltage to a region of the active layer 13, the region tends to deform (expand/contract) in accordance with the piezo-electric properties of the layer 13. However, deformation of the active layer surface facing the interface 18 is restricted due to its coupling to the passive layer 16. This causes the panel (e.g. active layer 13 and the passive layer coupled thereto) to bend/curve and deform at the region of the applied voltage and thereby protrude in a predetermined/preferred direction. For example a voltage expanding the active layer will affect a convex shape of the transducer region 10 while voltage contracting the active layer will affect a concave shape of the transducer region 10.

As indicated above according to some embodiments of the present invention, in in-operative state the transducer 10 is flat. In this configuration, the transducer may be operated utilizing a predetermined DC bias voltage for raising/curving the active layer 13 from its flat position while the passive, stiff, layer 16 imposes strain on the bottom side of the active layer 13 through the interface 18 between them. This strain creates a dome-like structure of the active layer 13 thereby enabling the active layer 13 to provide vibrations (under AC electric signals) in the transverse direction along the Z axis.

Figure 3A:
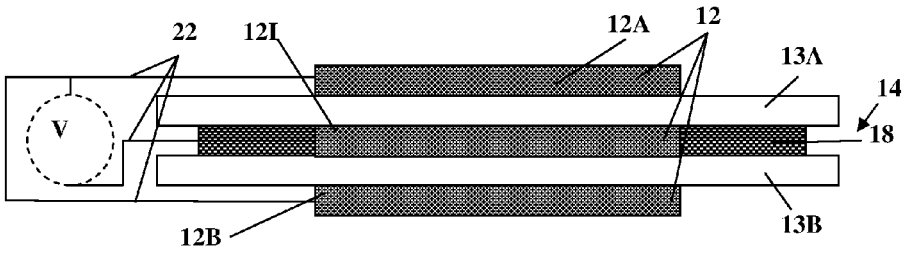
FIGS. 3A-3B exemplify two bi-morph configurations of a transducer formed with two active layers coupled together enabling independent control of the deformation of different zones in the layers of the transducer's panel.
Figure 3B:
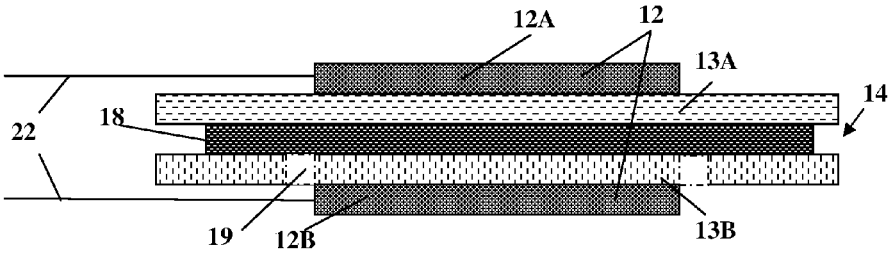

Reference is made to FIGS. 3A and 3B showing two examples of panel 14 formed according to the present invention by utilizing a bi-morph configuration of two active (piezo-electric) layers 13A and 13B. These figures illustrate a partial side view of the panel 14 including one transducer 10. In similar to the bi-morph configuration of passive and active layers illustrated in FIG. 2C, also in these examples the region of transducer 10 may be flat in its in-operative state and operated with predetermined voltage to deformed towards a predetermined curved shape protruding outside of the surface of the panel 14. To this end, the panel 14 includes at least two active layers 13A and 13B which are attached together by bonding layer at interface 18. Electric contacts 12 coupled to the active layers 13A and 13B are arranged and configured to enable deforming these layers 13A and 13B in opposite directions upon application of proper electric signals provided through the contacts 12.

In the example of FIG. 3A, the active layers 13A and 13B are two piezo electric layers/sheets oriented with similar or different polarities with respect to one another. The transducer 10 is associated with at least three electric contacts 12 wherein at least one electric contact is located between the active layers (e.g. at the interface 18 and two or more other electric contacts 12 are located/connected above and below the respective active layers 13A and 13B of the panel 14. The electric contacts are wired to the signal transmission arrangement such that transmission lines 22 may be used apply opposite/different voltages to the different active layers 13A and 13B, to thereby deform those layers to different degrees of expansion/contraction (for example cause one of the active layers 13A to expand while the other active layer 13B contracts).

In this regards, it should be noted that the electric contact(s) located at the interface 18 of transducer region 10 may include a single electric contact 12I (e.g. ground) electrically coupled to both the layers 13A and 13B. In this case the electric contacts 12A and 12B respectively connected to layers 13A and 13B from above and below may be provided with different potentials/voltages to independently control the piezo-electric deformation of layers 13A and 13B at the region of the transducer 10. This enables to deform different zones (in this case layers) associated with the transducer 10 to different degrees and thus provides better control on the dynamic shape deformation of the region of the transducer 10 during its operation and improved electrical-mechanical conversion efficiency. Specifically, the independent control over the deformation degree of each of the zones (layers) may be used to reduce strain/tension between the zones/layers during the operation of the transducer 10 and thus allow the transducer to operate more efficiently and accurately which may in some cases improve the dynamic range and or the signal to noise ratio (SNR) associated with the transducer.

It should be noted that in some embodiments the intermediate electric contact 12I at interface 18 may be replaced by two or more electric contacts respectively coupled to the layers 13A and 13B. As will be readily appreciated by those versed in the art, one or more of the electric contact 12A, 12B and 12I may be common to multiple transducers on the panel 14 while still enabling independent operation of the multiple transducers, In the example of FIG. 3B the active layers 13A and 13B are oriented with opposite polarities of their piezo-electric materials/sheets. The electric contacts 12, including contacts 12A and 12B are respectively coupled to layers 13A and 13B from above and below of the panel 14. Accordingly, voltage applied in between contacts 12A and 12B causes one of the layers to expand while the other contracts. Due to the fact that the sheets are flexible sheets attached together, such deformation of the sheets causes the region of the panel to curve in an appropriate/predetermined direction in response to predetermined electric field/voltage applied between the contacts 12A and 12B. Also, in this example, different zones (in this example—layers) associated with the transducer 10 may deform to different degrees (one expands and one contracts) in response to the applied voltage thus causing the panel to deform in a predetermined direction while reducing strain/tension between the zones/layers to improve the electrical-mechanical conversion efficiency of transducer 10 and in some cases also the dynamic range and SNR of the transducer 10. It should however be noted that according to some embodiments, the piezo-electric sheets are relatively flexible sheets and the deformation of the transducer upon applying appropriate voltage may be in the order of several microns (e.g. 10-50 μm or 100-500 μm), and thus the strain/tension caused by deformation of the sheets is negligible.

As noted above, in some embodiments of the present invention utilizing bi-morph configuration of the panel 14 with two or more layers/sheets (e.g. active-active layer configuration as that of FIGS. 3A and 3B and or active-passive configuration as that of FIG. 2C), discontinuities/cuts may be defined in one of the layers the periphery region RP enclosing the active regions RA of the transducers 10. The discontinuities/cuts improve the ability of the active transducer regions RA to move and vibrate under operation thus improving the efficiency, dynamic range and sensitivity of the transducers. This is shown for example in FIG. 3B. Here one or more of the active layers may be cut 19 at selected locations on the periphery of the region RP defining a transducer 10. The cuts 19, or discontinuity of the one or more active layers allows for perpendicular movement of the corresponding active layer (i.e. away from the surface of the transducer system). The cuts 19 may be continuous or segmented and may be filled with flexible material of electrically isolating liquids having refractive index being similar, or at least as similar as possible to the refractive index of the active layer.

Figure 4A:
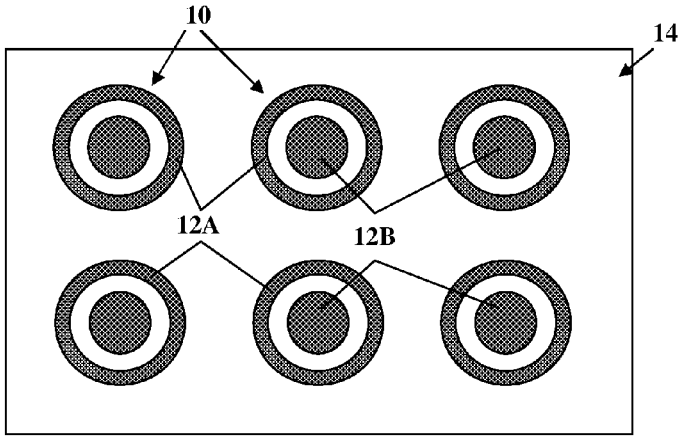
FIGS. 4A-4B exemplify a transducer configurations configured with lateral concentric electrode arrangement enabling independent control of the deformation of periphery and central zones of the transducers.
Figure 4B:
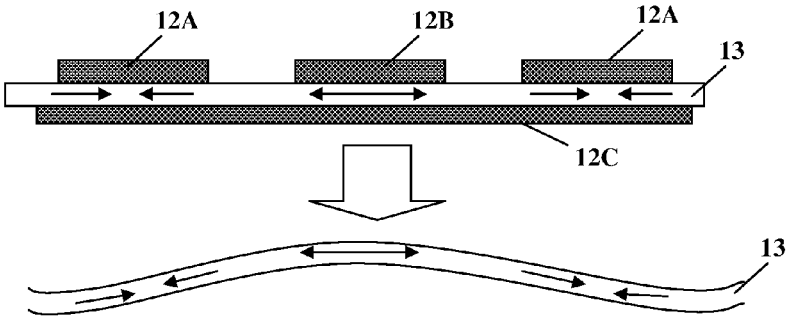

Reference is made to FIGS. 4A and 4B respectively illustrating top and side views of a panel 14 including transducer 10 configured according to another embodiment of the present invention. Here a spatial lateral arrangement and shapes of the electric contacts from at least one side of an active layer (piezo-electric sheet) are arranged to enable separate control over the degree of deformation of the different lateral zones in the transducer region R.

FIG. 4A shows a top view of transducer system 100, illustrating a part of panel 14 which includes piezo-electric material and is segmented to plurality of separately activated transducers by electric contacts 12A and 12B couple to regions of the panel. FIG. 4B is a side view of a single transducer 10 of FIG. 4A. According to some embodiments of the present invention, the panel 14 shown in FIGS. 4A and 4B, may be configured to be transparent to visible light and may be implemented utilizing the materials and techniques described above. The electric contacts 12A and 12B coupled to at least one surface of the panel 14 (and to the at least one piezo-electric sheet) and divide each transducer into periphery and central regions RP and RA. The peripheral and central regions, RP and RA, constitute in this case different zones of the transducer region R which piezo-electric deformation can be separately controlled by the electric contact. The electric contacts 12A and 12B are enable to generate electric fields of opposite direction and/or or different magnitudes in the periphery and central regions of the transducer, to thereby deform these regions to different degrees (e.g. cause one of the regions to expand while the other contracts). In the example of FIGS. 4A and 4B, the panel 14 has a single active layer 13, however, it should be noted that additional active layers may be used as will be described below.

As shown, the active layer 13 (piezo-electric sheet) is couple to two electric contacts' portions 12A and 12B along its top side, and to one or more electric contacts 12C along its other side. Here the electric contacts 12A and 12B are arranged laterally in concentric manner on one surface of the active layer 13. It should be noted that the electric contacts coupled to the bottom side of the panel 14 or of the active layer 13 may be a single electric contact having ground connection or segmented electric contacts corresponding to contacts 12A and 12B and configured to operate therewith to generate appropriate electric field. In the case of a single grounded contact 12C, the direction of electric field is determined by the sign of the voltage applied to contacts 12A and 12B. FIG. 4B exemplifies the operational principles of the transducers according to this embodiment of the invention. To provide directional deformation of the transducer, electric contact 12A is configured to provide electric field to cause the piezo-electric sheet 13 to contract/expand at the periphery of the transducer to a certain degree, while electric contact 12B provides electric field to cause the central region of the transducer to contract/expand to certain other degree. The applied electric potential may be configured to contract the periphery while expanding the central region or vice versa, or to deform both the periphery and the central region in the same direction but with different degrees/magnitudes of deformation. This regional/bimorph deformation of the piezo-electric sheet 13 causes the central region of the transducer 10 to rise out of the surface while the periphery region bend to form a dome-like shape of the transducer. It should be noted that such directional deformation can be maintained by providing DC bias to the electric contacts. Additionally, an alternating electrical signal can accompany such DC bias to cause the transducer to vibrate at a selected frequency around the dome-like shape caused by the bias voltage.

Figure 5A:
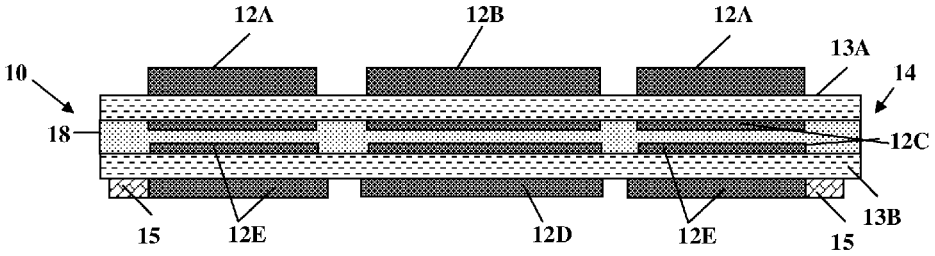
FIGS. 5A-5B illustrate additional possible configurations of transducers according to two embodiments of the present invention which are designed to enhance acoustic efficiency of the transducer.
Figure 5B:
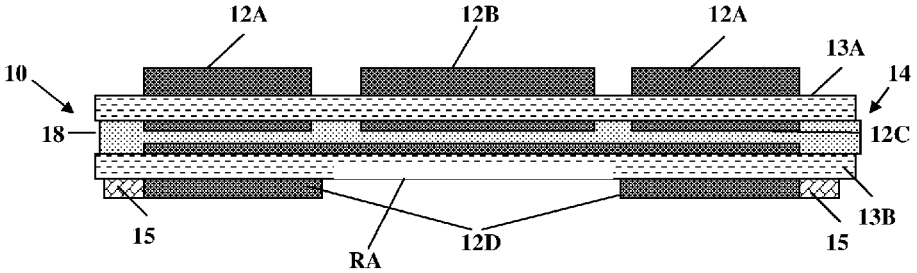

FIGS. 5A and 5B illustrate side views of two other configurations of bi-morph transducer arrangement (optionally transparent) utilizing two active layers 13A and 13B of the panel 14 and lateral and vertical arrangement of electric contacts 12A-12E arranged in transducer region R of the panel 14. The bi-morph configuration enables to deform/curve the region R of the panel in predetermined desired direction.

As shown in FIG. 5A the top active layer 13A is associated with electric contacts 12A and 12B coupled to top surface of the layer 13A defining periphery and central region of the transducer respectively. Additionally electric contacts 12D and 12E are coupled to the bottom surface of the bottom layer 13B also defining corresponding periphery and central regions. An electric contact 12C is located between the two layers and may be a single grounded electric contact or several contacts associated with contacts 12A-12B and 12D-12E. The two active layers 13A and 13B are attached together by an elastic bonding layer 18 to bond the active layers together, and active layer 13B is attached to a surface of a substrate (display unit or other surface of an associate device) by bonding points 15. As indicated above, the electric contacts dividing the transducer to periphery and central regions are capable to provide different electric potentials to cause the panel at the region of the transducer to deform in a predetermined direction. Such electric contacts configuration, with single grounded contact between the active layers or several contacts corresponding to contacts 12A-12B and 12D-12E, can be operated to provide directional deformation in several operational techniques providing a DC bias, as follows: electric contact 12A of layer 13A provides electric field causing the periphery region of the transducer to contract, contact 12B provided electric field causing layer 13A at the central region of the transducer to expand and the electric contacts coupled to layer 13B provide electric field causing expansion of the piezo-electric sheet in the region Alternatively, the electric contacts may be operated to provide DC bias to expand the central region and contract periphery region of layer 13B, while expanding layer 13A. It should be noted that according to some embodiments, the electric contacts 12D-12E coupled to layer 13B may be replace by a single electric contact configured to deform (expand and contract) the region associated with the transducer as a whole, while electric contacts 12A-12B cause deformation of different zones of active layer 13A. It should also be noted that such DC bias can cause the panel at the region of a transducer to deform in a preferred direction perpendicular to the surface of the transducer system. Additionally, a selected alternating signal may be provided via the electric contacts to cause the transducer to mechanically vibrate around the dome-like deformation caused by the DC bias as described above, to thereby generate vibration or acoustic signals of a desired frequency range.

FIG. 5B illustrates additional configuration utilizing a similar electric contacts' configuration associated with layer 13A as shown in FIG. 5A. However, in this configuration, a discontinuity/cut is introduced/etched in the central region RA of layer 13B. The central region RA is configured to be very thin relative to the thickness of other regions of the active layer 13B. The thinner central region RA of layer 13B allows the central region of layer 13A to expand easily during operation of the transducer and thus create the desired dome-like structure. Additionally, the thinner region of layer 13B provides for avoiding optical aberrations and reduces resistance on the top layer 13A.

It should be noted that the embodiments of FIGS. 2B-5B illustrate several examples configured to provide the panel 14 of the transducer system 100 to deform at region defining one or more transducers 10 in a predetermined direction perpendicular to the surface of the transducer system 100. The above described techniques may be implemented independently or in combination to provide a desired direction of deformation of the panel 14. It should also be noted that directional deformation of the panel 14 is aimed at enabling the transducer system 100 to provide substantially directional acoustic signals in response to electric signals transmitted thereto via the signal transmission arrangement. However the divergence of acoustic signals generated by one or more transducers 10 of the system 100 is determined by the frequency of the acoustic signal and an effective combined area of the one or more transducers generating the signal.

In addition to the above described transducers' structure, the transducer system of the present invention may be further laminated with a thin layer configured to provide mechanical protection and/or electric isolation of the panel 14 and electric contacts 12 applied thereon. Such thin layer may be formed of a flexible polymer such as Polytetrafluoroethylene (PTFE), polyester or other suitable materials. The coating layer is preferably thin and flexible such as to allow acoustic signals to be transferred through the coating without significant loss. Additionally, the outer surface of the transducer system may be coated with anti-reflection coating to reduce outside glare and enhance light coupling from a display unit which may be located under the system.

Figure 6A:
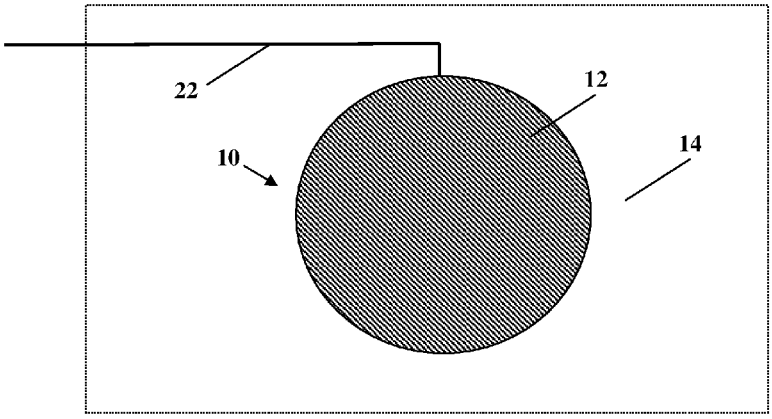
FIGS. 6A-6B exemplify configurations of electrical contacts positioned on top of the panel and being suitable for operation of the transducers.
Figure 6B:
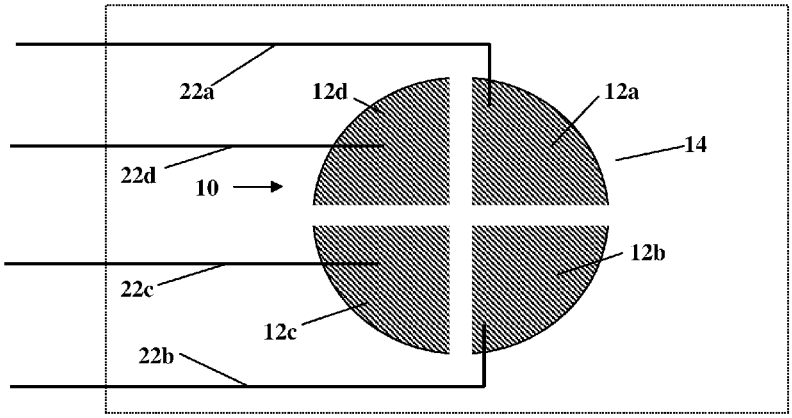

Additionally, the electric contacts 12 coupled to the piezo-electric material may be configured to cover the entire region of the transducers or only parts thereof and may be configured as a mesh or surface coating. References is now made to FIGS. 6A-6B illustrating a top view of a part of the panel 14 and showing a region R of one transducer 10 according to embodiments of the invention. In FIG. 6A a region of the panel of a single transducer 10 is coupled to an electrical contact 12 configured as a single element electrical contact covering the entire region associated with the transducer 10. Alternatively, as shown in FIG. 6B, the electrical contacts 12 of the transducers may be configured as several portions of electrical contacts, in this specific not-limiting example, four such contact portions 12*a*-12*d* are shown. Generally, the electrical contacts 12 may be patterned with sub-features being separated or touch between them. For example, the electrical contacts 12 may be formed by several contact portions as shown in FIG. 4B, formed as a mesh or grid or having any other pattern within the region of a transducer 10. When the contact portions 12*a*-12*d* are disconnected from each other, each contact portion may be associated with a dedicated electrical wire 22*a*-22*d*, thereby providing desired electrical signals to each of the contact portions. Such configuration of the electrical contacts may improve resolution of touch sensitive panel (e.g. touch screen), either when utilized by detection of external pressure by the transducer system 100 of the invention, or when such capabilities are provided by a separate layer, e.g. capacitance base touch sensitive layer (or any other touch screen layer), located on top or below the transducer system.

As indicated above, and as illustrated in FIG. 1A, the transducer system 100 of the present invention may be associated with a control unit 30 configured to selectively operate transducers 10 of the transducer system 100 to generate mechanical vibrations and/or acoustic signals of one or more frequency ranges. Thus the transducer system can be operated for use as a speaker system and or to provide vibration feedback in the form of heptic feedback being local, i.e. associated with one or a few transducers of the system located in a certain zone on the surface of the system, or global, i.e. associated with several zones on the surface or with the entire surface of the system. Additionally, the transducers 10 of the transducer system 100 may be operable to generate electric signals in response to external pressure, e.g. touch or acoustic waves impinging on one or more transducers, to provide the control unit with data indicative of at least one of strength, type, frequency and location on the surface of the system of the external pressure.

Figure 7A:
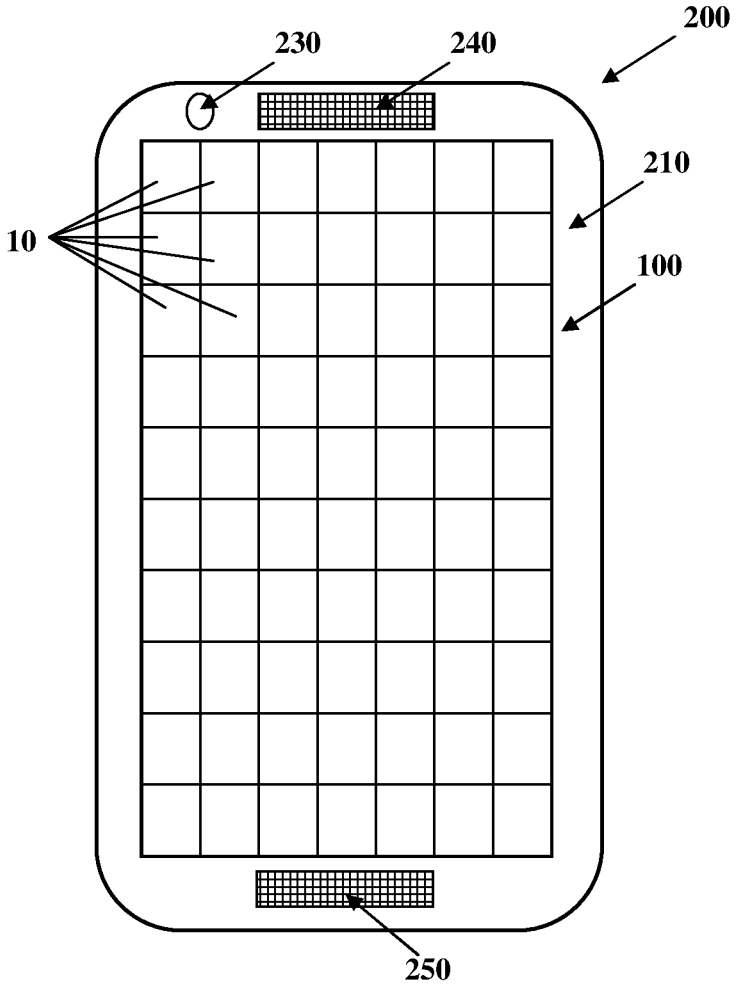
FIGS. 7A-7B illustrate how the transducer system of the present invention can be embedded in an electronic device according to an embodiment of the present invention.
Figure 7B:
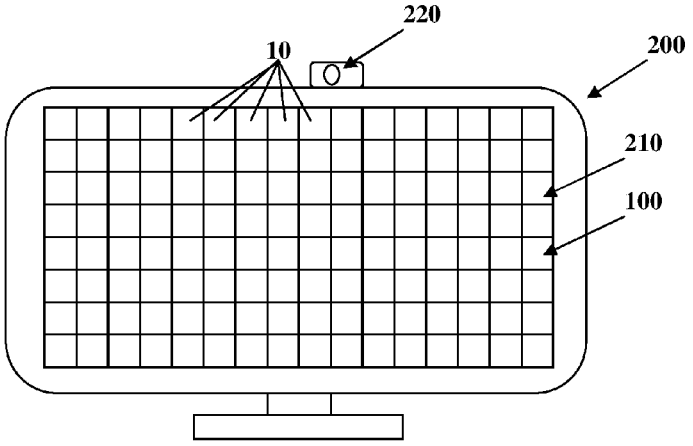

Reference is now made to FIGS. 7A-7B illustrating two examples of electronic devices 200 utilizing a transducer system 100 according to the present invention; FIG. 7A illustrates a hand held electronic device, e.g. a mobile phone device, and FIG. 7B illustrates an example of non portable electronic device, e.g. TV display system or any other non portable device. These two non limiting examples illustrate how the transducer system 100 of the present invention can be embedded into an electronic device to provide desired input/output utilities of the device. The electronic device 200 may have a display unit 210 configured to provide output display in accordance with operation of the device. The transducer system 100, when embedded into an electronic device 200, may utilize a processor utility (not specifically shown) of the device as the associated control unit 30 as exemplified in FIG. 1A. The processor utility of the device 200 may be configured to operate the transducer system 100 in one or more operational schemes suitable for use with the specific device 200. It should be noted that in embodiments where the transducer system 100 of the invention is embedded in an electronic device 200 having a display unit 210, the transducer system 100 may be optically transparent and may be located on top of the display unit 210. In such embodiments, the signal transmission arrangement (not specifically shown here) of the transducer system may include electrically conductive optically transparent wires. Alternatively, the electric wires of the signal transmission arrangement may be routed along the surface of the transducer system to pass substantially in dead regions between pixels of the display unit 210. The electronic device 200 typically also includes additional input/output utilities 220 such as camera(s) 230, speaker(s) 240 and microphone(s) 250, FIG. 7A illustrates individual input/output utilities (230, 240 and 250) and FIG. 7B illustrates an input/output utility box 220. The input/output utilities may be used for acoustic and optical input/output and may operate in combination with the operation of the transducer unit 100. For example, the transducer may be operated to detect sound fields and utilize such data to reduce noise relative to sound input from the microphone 240, or the transducer system may be operated as a sonar to locate a selected user in combination with image data received from the camera 230.

For example, in embodiments where the transducer system 100 is embedded in a electronic device such as portable devices, mobile phones, tablets, TVs etc. the transducer system may be configured to be optically transparent and the processor utility of the device can operate the transducer system in one or more of the following schemes:

(i) Operation as audio band speaker. During telephone calls the control unit operates some transducers of the system to generate audio band acoustic signals corresponding to sound to be generated during the call, i.e. some of the transducers operate as speaker to provide sound to the user's ears. Additionally, some other transducers may be operated to generate electric signals in response to sound and thereby operate as microphone of the device 200. Alternatively, the device may utilize a conventional microphone for telephone conversations.

(ii) Operation as audio-band loud speaker. The control unit may operate all or some of the transducers 10 of the system to generate acoustic signals of audio-band frequencies such that the transducer system can operate as loud speaker system. For example, the control unit may separately operate groups of transducers located on two sides of the system to provide stereo audio-band sound, or to operate a single group of transducers to provide mono audio-band sound signals. Additionally, the control unit may operate one or more of the transducers to be responsive to acoustic signals at their vicinity to enable hands free telephone conversation. To this end, one or two groups of transducers are operated to generate audio-band sound while one other group of transducers is operated as a microphone to record sound, the control unit may operate as a telephone unit to transmit the recorded sound and to receive data indicative of the sound to be generated. Additionally, it should be noted that as the transducers may be operated as microphones or speaker(s), any functionality that can be provided by a standard speaker or microphone can be provided by the correspondence transducers of the transducer system in accordance with appropriate operation of the control unit.

(iii) Localized sound generation system. The control unit may operate the transducer system to provide localized sound field. To this end the control unit operated transducers of the transducer system to generate acoustic signals of one or more ultra-sound (US) frequencies, the US acoustic signals are much less divergent relative to audio-band signals, due to the high frequency, thus operation of the plurality of transducers to generate US signal can utilize beam forming technique to direct the signal in a desired direction by steering and focusing the generated sound field to the desired directions/location. To this end, it should be noted that localized sound field can be most effectively generated in the near field (in which both focusing and steering can be achieved by beam forming) To this end short wavelength acoustic beam (e.g. US beams) may be preferably utilized, as they are associated with longer Rayleigh distance as compared with that of audible sound, thus resulting with and extended near field region at which localized sound field can be produced. By generating a specific pattern of US signals towards a desired location, the pressure waves caused by the US signals may cause non-linear interaction to thereby enable only a listener located at a specific point to hear audio-band signal resulting from the non-linear interaction. Such functionalities of the transducer system of the present invention are described in PCT patent application no. PCT/IL2013/050952 assigned to the assignee of the present application. Utilizing the principles of beam forming the transducer system can be operated by the control unit to direct the localized sound field to desired locations. Additionally, the control unit may, for example, operate several (one or more, or all of) transducers to generate US signals having equal phase and amplitude, thus creating a so-called "parametric array", This generates a laser like sound beam providing a directional sound field which can propagate along distances. Utilizing this technique the transducer system may be used with (or in) an electronic device to provide sound to a desired user while preventing others from hearing it.

(iv) US input mode. Some of the transducers may be operated (by the control unit) to be responsive to US acoustic signals reflected back from the surrounding to provide data indicative of location of a desired user. Such US input mode may be based on two main themes, Sonar mode and Doppler mode. The Sonar mode is based on generating and detecting sonar like signals which assist in determining the spatial location of a user. And the Doppler mode utilizes reflected signals being the result of a focused US beam on the user face that is returned to the device Doppler modulated. This modulation can be cross referenced to the regular microphone of the device in order to filter out non user noises. Thus the transducer system may be used in an electronic device to enable sound input from a desired user while monitoring (detecting) location of the user and utilizing Doppler effects to filter out noise from the input sound field. It should be noted that the transducer system, together with an associated electronic device may, also utilized a microphone (capable of detecting US signals or not) as a main sound input utility while the transducer system provides data indicative of source of detected sound signals to thereby provide filtering of non-user noises.

(v) The transducer system may be operated to provide touch sensitive surface of the device, i.e. as an input utility being sensitive to touch. This may be provided utilizing several techniques: (a) Self Capacitance configuration: The electric contacts located on the outer surface of the panel can operate as capacitance-based sensing electrodes. Typically, the resolution provided by the transducers' arrangement in the system might be insufficient to provide high-resolution touch sensitive surface, however this may be solved by providing segmented electric contacts, e.g. as illustrated in FIG. 6B to provide fine spatial features and enable sub-feature resolution detection. When the transducers operate in acoustical transmitter/receiver mode, the sub-features may are operated together to form a full pad coverage of the transducer. (b) Piezo mode touch sensor: The one or more piezo-electric material/sheet of the panel generates electric signals in response to external pressure. Differently from capacitance based touch-sensing, the external pressure (of a finger) can be detected even when generated by isolated fingers (i.e. wearing gloves). It should however be noted that piezo-electric materials are sensitive to impulses and may has weak detection for continues touch; the system therefore may be configured to detect and memorize the initial touch impulse caused by a first touch, and a detachment impulse when the finger is lifted. Alternatively, a sweep to neighbor electrode is detected if finger slides sideways. Due to the fact that the transducers of the system are individually operated, each transducer can response to touch independent of the other transducers, thereby providing increased multi-touch capabilities. (c) Foil surface acoustic waves: The control unit may operate several transducers, located a side of the panel (array) to emit sound pulses at high frequency (preferably higher than any usable acoustic frequency, to provide complete isolation from other acoustical tasks performed by the transducers). Each side transducer generates a short ping pulse of high frequency burst, and these pulses are being detected by transducers at the other extreme side. If an object or finger touches the panel, the sound pulse is disturbed, and the location of the disturbance can be detected. These techniques may be applied in both horizontal and vertical axes of the transducer system at different frequencies to detected touch in both axes. Additionally, this can be implemented on separate segments of the transducer system, where extreme transducers of each segment generate ping signals being detected by other extreme transducers of the same segment. This technique may be implemented simultaneously or by scanning the surface of the transducer system by pairs of transmitter and receiver transducers.

(vi) Virtual/physical keyboard. In some embodiments, were the transducers are configured to deform to a dome-like structure, the control unit may provide certain DC voltage to selected transducers to cause the transducers to stick up from the surface of the transducer system. This can provide keyboard functionality as follows: the device displays a virtual keyboard on the display unit where the location of the different keys are correlated with location of transducers in the transducer system; the control unit provide DC voltage to the corresponding transducers and causes them to stick up from the surface in dome-like form; Thus providing a user with keyboard feeling on the surface of the device. It should be noted that even when provided with DC voltage, the transducers may be responsive to external pressure and provide a corresponding signal, thus transducer system may be operated to provide an actual keyboard based on a virtual one.

(vii) The transducer system may also be operated by the control unit to provide haptic feedback to such external pressure by providing transducers at the vicinity of the external pressure with electric signals that will be converted to mechanical vibration of a selected "low" frequency (e.g. 2-200 Hz). Such haptic feedback can provide a user with sufficient feedback that the surface was touched at a desired location. Such localized mechanical vibrations may be used for other user interface options and as vibration feedback as an output utility of the device. Such haptic feedback functionality may be utilized when the transducer itself generate indication of external pressure, or when the transducer system is used in combination with a dedicated touch sensitive panel (e.g. touch screen panel). Additionally the control unit may also operate certain transducers to vibrate to provide a feel by the finger of various surface-roughness emulation, i.e. various transducers vibrate in corresponding frequencies and amplitudes to vary the feel of the surface and emulate roughness at various degrees.

(viii) The transducer system may be operated as ultrasound (US) proximity detector to provide high resolution touch detection capabilities. Several transducers, at one side of the periphery of the transducer system may be operated to transmit high-frequency US signals, and several other transducers, at another side of the periphery of the transducer system, may be operated to detect these signal. When an object is brought to close proximity from the surface of the transducer system these high-frequency US signals are damped or reflected from the object and are not detected by the detecting transducers or are modified before detection. Operating two rows of transducers in such a scheme can provide proximity/touch detection with resolution being higher than the transducer density along the surface.

(ix) The transducer system may be operate to transmit US acoustic signals and be responsive to reflected acoustic US signal to thereby operate as a SONAR to enable the control unit to identify distances and direction of objects surrounding the system.

In various embodiments where the transducer system is embedded in electronic devices some of the above operational scheme may be used in accordance with desired features to be provided by the electronic device.

Figure 8A:
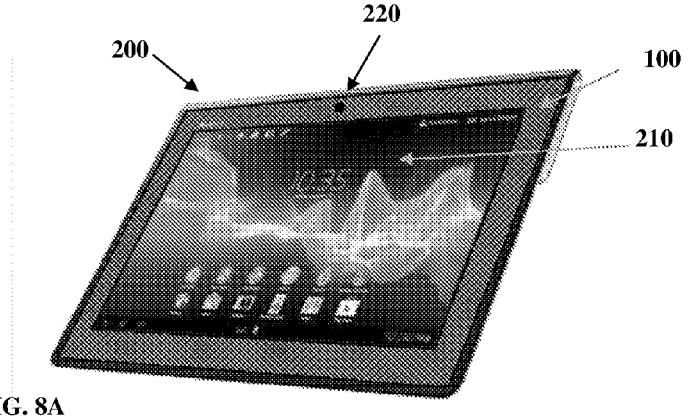
FIGS. 8A-8B illustrate how the transducer system of the present invention can be embedded in an electronic device according to another embodiment of the present invention.
Figure 8B:
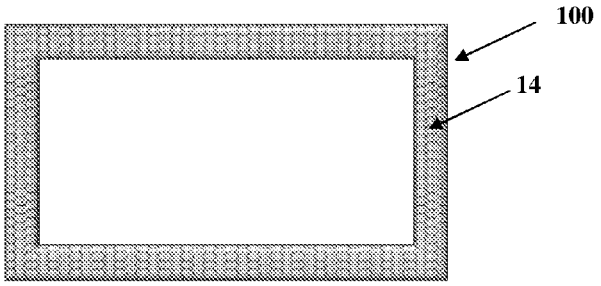

For example, FIGS. 8A and 8B respectively illustrate an example of an electronic device 200 configured according to another embodiment of the present invention, and a panel 14 of a transducer system configured according to an embodiment of the present invention, to be embedded in the electronic device of FIG. 8A. Here, the electronic device 200 includes a display unit (screen) 210 and a transducer system 100 according to the present invention. The electronic device may be for example a hand held electronic device, e.g. a mobile phone or tablet device, and/or a non portable electronic device, e.g. TV display system, smartphone docking station or any other non portable device. In this example the transducer system 100 is embedded into an electronic device and is arranged at peripheral regions outside of the display area of the device. For example, the panel 14 of the transducer system 100 may be arranged at the front side of the device and/or at one or more of the sides of the device (e.g. on one or more sidewalls), and/or as illustrated in the present example, the panel 14 of the transducer system 100 may be furnished at one or more regions at the frame of the display unit 210. To this end, the transducer system 200 (e.g. panel 14 thereof) may or may not be optically transparent to visible light, and in some cases it may be opaque.

As in the example of FIGS. 7A and 7B, also the transducer system 100 of FIGS. 8A and 8B may be associated with a processor utility (not specifically shown) which may be that of the electronic device 200 itself, or a separate processing utility. The processor utility may be configured to operate the transducer system 100 in one or more operational schemes suitable for use with the specific device 200. The electronic device 200 may also include additional input/output utilities (e.g. camera(s), speaker(s), microphone(s)) for providing acoustic and/or optical input/output and the transducer system 100 may operate in combination with the operation of the input/output utilities of the electronic device 200.

In various embodiments of the present invention the transducer system may be configured and operable for performing the one or more of the operational schemes (i) to (ix) listed above. In this connection the following should be noted. In cases where the transducer system 100 is to be operated as an audio band speaker (scheme (i) above), the panel and or at least certain parts thereof should preferably be furnished at a region of the electronic device associated with the location of user ear when the device is used. In cases where the transducer system 100 is to be operated according to schemes (iii), (iv) and (ix) above for generating localized sound fields, and/or operate in an US input mode or in a sonar mode, the transducer elements of the transducer system 100 should preferably be spatially arranged so as to spread-out and extend over a relatively large area, in order to enable generation/and or reception of localized/focused audio wave beams (e.g. to enable accurate spatial beam forming) To this end, in such cases the panel 14 of the transducer system 100 may preferably be furnished on the front of the electronic device (which is typically associated with larger areas than the sidewalls of the electronic device). Moreover, as the reception and/or transmission of audio signals from direction of the user (e.g. from the user's head) are more important, it is more preferable in some cases to furnish the panel 14 of the transducer system 100 at the front side of the electronic device (the side which faces the user when the device is used). To this end, as typically the front side of the electronic device 200 is mostly occupied by a display unit 210, the transducer system 100 (panel 14) may be located at regions associated with the frame of the display. This may allow the transducer elements to be spread over sufficiently large area so as to enable accurate enough beam forming and sound localization, while on the other hand, also efficiently generate and/or receive audio signals to/from the direction of the user using the electronic device 200. In this regards arranging the transducer system 100 (or panel 14 thereof) on the frame regions of the display unit, may also serve the operations of the transducer according to schemes (v) to (viii) described above, namely to operate as a touch sensitive surface serving as a key/control pad, and/or for providing haptic feedback to the user.

Thus the present invention provides a novel transducer system configuration suitable for use with various electronic devices. The transducer system may be configured with substantially flat form factor and may be compactly furnished at/on the casing of the electronic device. Optionally the panel of the transducer system may be configured to be transparent and may be placed over a display unit of the electronic device. Alternatively or additionally, the panel of the transducer system may be arranged at the frame of the display unit or at the sidewalls of the electronic device. The transducer system may be configured and operable for performing several various functions/operations such as to generate audible acoustic waves/sounds (such as a loud speaker and/or and ear speaker), to direct the acoustic waves to various directions (e.g. by controlling the operations of the individual transducer elements based on beam forming technologies known in the art); to generate ultrasound acoustic waves, which can be used for sound from ultrasound generations techniques (e.g. to generate localized sound fields as described for example in PCT patent application no. PCT/IL2013/050952) and/or for sonar applications and/or to operate as a touch sensitive surface; and/or to provide mechanical vibration and haptic feedback. A person of ordinary skill in the art will readily considering the above described embodiments of the present invention, will readily appreciate various modifications which may be applied to the above embodiments, for example in order to optimize them to one or more of the above listed functions, without departing from scope of the present invention as defined in the claims.

The invention claimed is:

1. A transducer system, comprising:

a panel including one or more piezo-electric sheets and an arrangement of electric contacts coupled to said panel and configured to define one or more transducers in said panel;

wherein at least one transducer of said one or more transducers, being located in the panel at a respective region of the panel, includes a lateral arrangement of at least two electric contacts respectively coupled to at least two lateral zones of said respective region of the transducer and including at least first and second electric contacts coupled to respectively a periphery zone and a central zone of said respective region; and wherein said lateral arrangement of the at least two electric contacts is configured and operable to enable provision of different electric fields in said at least two lateral zones for simultaneously causing different degrees of piezo-electric material deformation of said at least two lateral zones and thereby efficiently deforming said respective region of the transducer to curve a surface of said panel at said respective region, thereby enabling at least one of the following in said region: conversion of electrical signals to mechanical vibrations or conversion of mechanical vibrations to electrical signals.

2. The transducer system of claim 1, further comprising:

wherein said plurality of transducers are arranged in a predetermined geometry and spacing along said panel;

a signal transmission arrangement coupled to said arrangement of electric contacts and configured to provide electric connection thereto to independently operate said plurality of transducers for generating mechanical vibrations in one or more frequency ranges in response to electric signals provided thereto by said signal transmission arrangement.

3. The transducer system of claim 1, wherein said plurality of transducers are operable for at least one of the following: (i) generating mechanical vibrations in one or more acoustic frequency ranges including at least one of audio-band frequency range or ultra-sound frequency range;

or (ii) at least some of said transducers are capable of converting external pressure to an electric signal.

4. The transducer system of claim 1, wherein said panel includes one or more layers including one or more active layers formed with piezo-electric material capable of deforming in response to electric signals applied thereto to thereby generate said mechanical vibrations.

5. The transducer system of claim 4, wherein at least one of the following: (i) said panel includes at least one passive layer mechanically coupled to said one or more active layers in predetermined locations defined by said predetermined geometry, such that expansion and contraction of the respective zones in said region of the panel provides deformation of said region in a predetermined direction perpendicular to said surface; or (ii) said one or more active layers include at least two active layers, each formed with piezo-electric material capable of deforming in response to electric signals applied thereto; a region of said at least one transducer comprises two or more electric contacts electrically coupled to said at least two active layers in said region; said two or more electric contacts are configured to apply electric field in said region such as to expand a zone of one of said at least two active layers in said region and contract a zone of one other of said at least two layers in said region to thereby deform said region in a predetermined direction perpendicular to said surface.

6. The transducer system of claim 4, wherein said arrangement of electric contacts are electrically coupled to at least one region along at least a top surface and a bottom surface of said one or more active layers.

7. The transducer system of claim 1, wherein said panel includes at least one active layer; and wherein said at least two electric contacts are located from one side of said at least one active layer, and said panel includes at least a third electric contact located from an opposite side of said at least one active layer.

8. The transducer system of claim 1, wherein said region of the panel associated with the one or more of the plurality of transducers, is configured with a predetermined curvature along at least one axis parallel to said panel, such that expansion and contraction of respective zones of said region provide deformation of the panel in said region in a predetermined direction perpendicular to said panel.

9. The transducer system of claim 1, wherein said panel includes at least one active layer of piezo-electric sheet comprising a polymer piezo-electric sheet.

10. The transducer system of claim 1, wherein said panel is substantially transparent to visible light and wherein at least one of the following: (i) the one or more piezo-electric sheets of said panel are substantially optically transparent to visible light; or (ii) said electric contacts are optically transparent electric contacts.

11. The transducer system of claim 10, wherein at least one of the following: (a) said panel includes at least one active layer of piezo-electric sheet including a polymer piezo-electric sheet which includes PolyVinyliDene Fluoride (PVDF) based material; or (b) said arrangement of electric contacts on said optically transparent panel include at least one of the following: (i) substantially transparent mesh of thin metallic conductors; (ii) Carbon Nano-Tubes (CNT) thin coating; (iii) Graphene coating; (iv) Silver (Ag) nano-particles coating; (v) Indium Tin Oxide (ITO) ultra thin coating; (vi) Polyaniline transparent coating; (vii) Polythiophene transparent coating; or (viii) Poly(3,4-ethylenedioxythiophene)-poly(tryrenesulfonate) (PEDOT/PSS) transparent coating.

12. The transducer system of claim 1 wherein said different degrees of piezo-electric material deformation is associated with piezo-electric material expansion in at least one of said zones and piezo-electric material contraction in at least one other of said zones.

13. An electronic device, comprising:

the transducer system of claim 1; and a control unit, said control unit being connectable to a signal transmission arrangement and configured and operable for separate activation of said plurality of transducers by selectively providing electric signals through said signal transmission arrangement to selected electric contacts of selected transducers, to thereby generate acoustic signals in accordance with data indicative thereof received by said control unit.

14. The electronic device of claim 13, further comprising:

a display unit; and wherein at least one of the following: (i) said panel of the transducer system is configured to be furnished at one or more regions surrounding said display unit; or (ii) said panel of the transducer system is configured to be transparent to visible light and is located on top of said display unit.

15. The electronic device of claim 13, wherein said signal transmission arrangement is configured such that wires transmitting electric signals to and from electric contacts of selected transducers of the plurality of transducers are aligned along a surface above said display unit such that said wires being aligned to pass between pixels of said display unit to thereby leave pixels area free of obstacles.

16. The electronic device of claim 13, wherein said transducer system is operable as at least one of a touch pad and a microphone; said control unit is configured to receive electric signals indicative of external pressure applied to one or more of said plurality of transducers.

17. A transducer system, comprising:

a plurality of separately activated transducers arranges in a predetermined geometry and spacing at respective regions on a surface of a panel; and a signal transmission arrangement coupled to said plurality of separately activated transducers and configured to provide electric connection thereto said transducers;

wherein said panel includes: at least one active layer of piezo-electric material and at least one additional layer coupled to said at least one active layer of piezo-electric material to form a bi-morph piezo-electric sheet in at least one region of said regions being associated with a transducer;

wherein said signal transmission arrangement includes a lateral arrangement of at least two electric contacts electrically coupled to said active layer at two lateral zones of said region of the respective transducer and including at least first and second electric contacts coupled respectively to periphery and central zones of said respective region and configured and operable to enable provision of different electric fields at said at least two lateral zones to affect different degrees of piezo-electric material deformation in said at least two lateral zones and thereby efficiently deform said bi-morph piezo-electric sheet at said region of the transducer to curve said surface at said respective region in response to the provision of predetermined electric fields by said lateral arrangement of the at least two electric contacts.

18. The transducer system of claim 17 wherein said one additional layer being at least one of the following: a second active layer including piezo-electric material or a passive layer.

19. The transducer system of claim 17 wherein, in an inoperative state, said surface of the panel has substantially flat geometry; and wherein operation of said transducer is associated with provision of a bias potential to the one or more electric contacts to deform said region of the transducer to form a curved surface protruding in said predetermined direction.

20. The transducer system of claim 19 wherein said transducer is operable for at least one of the following: (i) generating mechanical vibrations in a certain frequency is associated with providing at least one of said electric contacts with alternating potential oscillating with said frequency, wherein said mechanical vibrations are associated with at least one of: acoustic signals or haptic feedback; or (ii) converting mechanical pressure applied to said curved surface into corresponding electric potential on at least one of said electric contacts.

* * * * *